US012605030B1

(12) United States Patent
Yang

(10) Patent No.: US 12,605,030 B1
(45) Date of Patent: Apr. 21, 2026

(54) SCRAPER

(71) Applicant: Maya Technologies Limited, Hong Kong (CN)

(72) Inventor: Shanglin Yang, Hong Kong (CN)

(73) Assignee: Maya Technologies Limited, Hong Kong (CN)

( * ) Notice: Subject to any disclaimer, the term of this patent is extended or adjusted under 35 U.S.C. 154(b) by 0 days.

(21) Appl. No.: 19/312,357

(22) Filed: Aug. 28, 2025

Related U.S. Application Data

(63) Continuation-in-part of application No. 19/190,853, filed on Apr. 28, 2025, now Pat. No. 12,472,650, and a continuation-in-part of application No. 19/189,307, filed on Apr. 25, 2025, now Pat. No. 12,458,193, said application No. 19/190,853 is a continuation-in-part of application No. 29/989,717, filed on Feb. 14, 2025, now Pat. No. Des. 1,096,038, said application No. 19/189,307 is a continuation-in-part of application No. 29/989,709, filed on Feb. 14, 2025, said application No. 19/190,853 is a continuation-in-part of application No. 29/989,709, filed on Feb. 14, 2025, said application No. 19/189,307 is a continuation-in-part of application No. 29/989,717, filed on Feb. 14, 2025, now Pat. No. Des. 1,096,038.

(30) Foreign Application Priority Data

| | | |
|---|---|---|
| Apr. 1, 2025 | (CN) | 202520601410.5 |
| Apr. 1, 2025 | (CN) | 202520601429.X |
| Aug. 4, 2025 | (CN) | 202521646338.4 |
| Aug. 4, 2025 | (CN) | 202521646345.4 |
| Aug. 4, 2025 | (CN) | 202521646351.X |

(51) Int. Cl.
*A47L 13/022* (2006.01)
*A47L 13/08* (2006.01)

(52) U.S. Cl.
CPC ..... *A47L 13/022* (2013.01); *A47L 13/08* (2013.01)

(58) Field of Classification Search
CPC ..... A47L 13/02; A47L 13/022; A47L 13/08; B25G 1/08; B44D 3/162; B44D 3/164
USPC ..... 15/236.01; 30/125
See application file for complete search history.

(56) References Cited

U.S. PATENT DOCUMENTS

| | | | | |
|---|---|---|---|---|
| 3,577,637 A * | 5/1971 | Braginetz | B26B 5/001 | 30/162 |
| 3,593,417 A * | 7/1971 | West | B26B 5/001 | 30/125 |
| 5,386,632 A * | 2/1995 | Schmidt | B26B 29/02 | 30/162 |

(Continued)

*Primary Examiner* — Tom Rodgers

(57) ABSTRACT

A scraper includes a main body and a cover. The main body includes a top shell body and a bottom shell body. The top shell body and the bottom shell body are engaged with each other and cooperatively define a receiving cavity with an access opening. The receiving cavity is configured to store spare blades. The cover is hinged to the main body, and rotatable about a hinge axis between the cover and the main body to close or open the access opening. The main body further includes a shaft reinforcement portion, the shaft reinforcement portion is arranged close to a hinge position between the cover and the main body, and the top shell body and the bottom shell body are connected with each other via the shaft reinforcement portion.

12 Claims, 16 Drawing Sheets

(56) References Cited

U.S. PATENT DOCUMENTS

| | | | | |
|---|---|---|---|---|
| 10,800,052 | B1 * | 10/2020 | Fossella | B26B 5/001 |
| 2004/0226175 | A1 * | 11/2004 | Ping | B26B 1/042 30/340 |

* cited by examiner

SCRAPER

CROSS REFERENCE TO RELATED APPLICATIONS

The present application is a continuation-in-part of the U.S. application Ser. No. 19/190,853, filed on Apr. 28, 2025; and the U.S. application Ser. No. 19/189,307, filed on Apr. 25, 2025. U.S. application Ser. No. 19/190,853 is a continuation-in-part of the U.S. application Ser. No. 29/989,717, filed on Feb. 14, 2025 and is a continuation-in-part of the U.S. application Ser. No. 29/989,709, filed on Feb. 14, 2025. U.S. application Ser. No. 19/189,307 is a continuation-in-part of the U.S. application Ser. No. 29/989,717, filed on Feb. 14, 2025 and is a continuation-in-part of the U.S. application Ser. No. 29/989,709, filed on Feb. 14, 2025. The present application claims priorities of: Chinese patent application No. 202520601410.5, filed on Apr. 1, 2025; Chinese patent application No. 202520601429.X, filed on Apr. 1, 2025; Chinese patent application No. 202521646338.4, filed on Aug. 4, 2025; Chinese patent application No. 202521646345.4, filed on Aug. 4, 2025; and Chinese patent application No. 202521646351.X, filed on Aug. 4, 2025. Contents of which are incorporated herein by their entireties.

FIELD OF THE DISCLOSURE

The present disclosure relates to the field of cleaning tools, and particularly to a scraper.

BACKGROUND

In existing scrapers, a cover is typically connected to a main body of the scraper in a single-axis hinge manner, allowing the cover to open or close an access opening for a corresponding storage cavity in the main body. The main body is usually formed by a top shell body and a bottom shell body which are interlocked with each other. However, a hinge mechanism between the cover and the main body relies on thin-walled portions of the top shell body and the bottom shell body to support opening and closing of the cover, which can easily cause cracking at a hinge area of the top shell body and the bottom shell body.

SUMMARY

The present disclosure provides a scraper. The scraper includes a main body and a cover. The main body includes a top shell body and a bottom shell body. The top shell body and the bottom shell body are engaged with each other and cooperatively define a receiving cavity with an access opening. The receiving cavity is configured to store spare blades. The cover is hinged to the main body, and rotatable about a hinge axis between the cover and the main body to close or open the access opening. The main body further includes a shaft reinforcement portion, the shaft reinforcement portion is arranged close to a hinge position between the cover and the main body, and the top shell body and the bottom shell body are connected with each other via the shaft reinforcement portion.

BRIEF DESCRIPTION OF THE DRAWINGS

Illustrative embodiments of the present disclosure are described in detail below with reference to the attached drawing figures.

REFERENCE NUMERALS IN THE DRAWINGS

Figure 1:
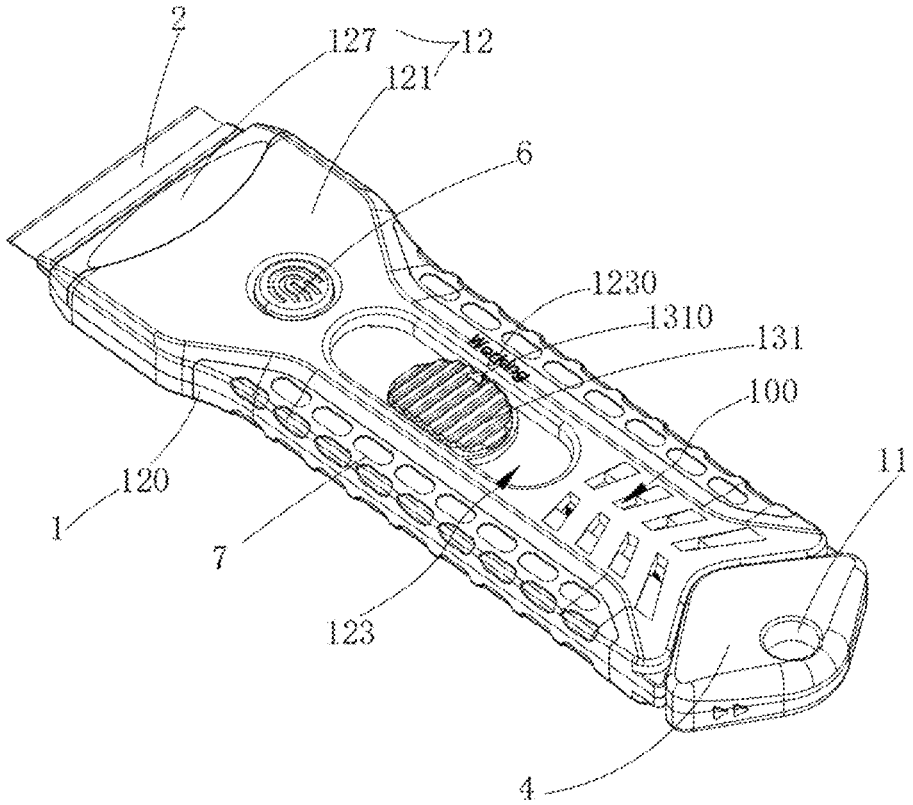
FIG. 1 is a first schematic view of an overall structure of a scraper according to some embodiments of the present disclosure.

1—main body; 10*a*—receiving cavity; 100—viewing window; 101—access opening; 102—operation notch; 103—engagement recess; 11—hanging through hole;

12—shell; 12*a*—mounting cavity; 12*a*1—first inner wall for forming the mounting cavity; 12*a*2—second inner wall for forming the mounting cavity; 12*b*—shaft reinforcement portion; 120—bottom shell body; 1200—fastening positioning protrusion; 1201—hook recess; 1202—locking groove; 121—top shell body; 1210—fastening positioning recess; 1211—engagement hook; 1212—locking hook; 1213—mounting through hole; 1214—front end wall of the top shell body; 122—inlet/outlet; 123—guiding hole; 1230—working state indicator; 124—first limiting recess; 1240—guiding wall; 1241—first limiting wall; 125—locking portion; 125*a*—locking recess; 1250—second limiting wall; 1251—third limiting wall; 1252—bottom wall; 126— first limiting portion; 1260—second limiting recess; 127—connecting bridge; 1270—limiting end wall; 128—limiting platform;

13—connecting member; 130—mounting portion; 1300—fixed plate; 1301—movable plate; 1302—clamping protrusion; 1303—clamping hole; 1304—hinge hole; 13040—insertion notch; 1305—free end; 1306—reset plate; 131—first button; 1310—indicator arrow; 132—connection body; 1320—base plate; 1321—functional plate; 1322—flexible connecting portion; 1323—accommodation hole; 133—elastic support portion; 1330—support leg; 1331—connecting end; 1332—contact end; 134—cooperating portion; 134*a*—limiting protrusion; 135—second limiting portion; 1350—fixed end; 1351—limiting end; 1352—overload protection leg; 0—included angle; 136—hinge rod; 137—avoidance through hole; 1370—force—bearing protrusion; 138—supporting protrusion;

15—shaft rod; 150—positioning shaft; 151—insertion rod;

2—working blade; 3—spare blade;

4—cover; 40—hinge portion; 400—connecting arm; 401—connecting through hole; 41—engagement portion; 42—protruding portion; 420—receiving groove; 421—guiding strip;

5—magnetic member; 6—second button; 7—soft rubber sleeve;

M—cleaning face;

F, F'—reaction force; F1, F1'—first component force; F2, F2'—second component force.

DETAILED DESCRIPTION

The following describes some non-limiting exemplary embodiments of the invention with reference to the accompanying drawings. The described embodiments are merely a part rather than all of the embodiments of the invention. All other embodiments obtained by a person of ordinary skill in the art based on the embodiments of the disclosure shall fall within the scope of the disclosure.

Unless otherwise defined, all technical and scientific terms used herein have the same meanings as commonly understood by those skilled in the technical field of the disclosure. The terms used in the specification of the disclosure are for describing specific embodiments only and are not intended to limit the disclosure. The terms "comprising" and "having" in the specification and claims of the disclosure, as well as any variations thereof, are intended to cover non-exclusive inclusion. The terms "first," "second," etc., in the specification and claims of the disclosure or the above drawings are used to distinguish different objects and not to describe a specific order.

In this document, reference to "embodiments" means that specific features, structures, or characteristics described in the embodiments may be included in at least one embodiment of the disclosure. The appearance of the phrase in various places in the specification does not necessarily refer to the same embodiment, nor is it an independent or alternative embodiment mutually exclusive with other embodiments. Those skilled in the art explicitly and implicitly understand that the embodiments described herein may be combined with other embodiments.

To enable those skilled in the art to better understand the solutions of the disclosure, the following clearly and completely describes the technical solutions in the embodiments of the disclosure with reference to the accompanying drawings.

Referring to FIGS. 1-16, the present disclosure provides a scraper. The scraper may include a main body 1. A working blade 2 may be mounted on the main body 1. The main body 1 may internally define a receiving cavity 10*a* for storing spare blades 3. A wall of the main body 1 for forming the receiving cavity 10*a* may define a viewing window 100 to allow a visual inspection of a remaining quantity of the spare blades 3 in the receiving cavity 10*a*.

Specifically, the main body 1 may be a flat elongated structure with a front end and a rear end that may be arranged away from each other. The working blade 2 may be mounted to the front end to facilitate the user to hold the main body 1 and push the working blade 2 for cleaning work. The receiving cavity 10*a* may be formed in the rear end of the main body 1. A width of the receiving cavity 10*a* may be larger than a thickness of the receiving cavity 10*a*. The width of the receiving cavity 10*a* may be slightly larger than a width of the spare blade 3, so that the spare blade 3 stored therein may not be prone to shaking in a width direction of the receiving cavity 10*a*. The thickness of the receiving cavity 10*a* may be much larger than a thickness of the spare blade 3, so that a plurality of spare blades 3 may be stacked in the receiving cavity 10*a*. The viewing window 100 may be formed in a portion of the wall of the main body 1 for forming the receiving cavity 10*a* in the width direction of the receiving cavity 10*a* or may be formed in a portion of the wall of the main body 1 for forming the receiving cavity 10*a* in a thickness direction of the receiving cavity 10*a*. For example, the viewing window 100 may be formed in the portion of the wall of the main body 1 for forming the receiving cavity 10*a* in the width direction of the receiving cavity 10*a*, the portion of the wall of the main body 1 for forming the receiving cavity 10*a* in the width direction of the receiving cavity 10*a* may provide a larger viewing area to ensure that the user may clearly observe the remaining quantity of the spare blades 3. In other embodiments, the viewing window 100 may also be replaced with a transparent glass plate or acrylic plate, or a transparent glass plate or acrylic plate may be mounted in the viewing window 100. In summary, through the viewing window 100 communicated with an exterior of on the receiving cavity 10*a*, the user may observe the remaining quantity of the spare blades 3 in the receiving cavity 10*a* in real time, avoiding a situation where there is no spare blades 3 in the receiving cavity 10*a* for replacement during use, so that the user may take the spare blade 3 from the receiving cavity 10*a* in time when the working blade 2 needs to be replaced, improving user experience of using the scraper.

In some embodiments, a plurality of viewing windows 100 may be formed, and the plurality of viewing windows 100 may be spaced apart from each other along a length direction of the receiving cavity 10*a*. The plurality of viewing windows 100 may expand the user's observation range and accurately identify the remaining quantity of the spare blades 3 stacked in the receiving cavity 10*a*. In addition, a single viewing window 100 may be in a contour of a long strip or in a circular contour; while the plurality of viewing windows 100 may form some regular grid patterns, which may improve aesthetics of the scraper while expanding the observation range.

In some embodiments, an access opening 101 may be formed in a wall of the rear end of the main body 1. The receiving cavity 10*a* may be communicated with an exterior of the main body 1 via the access opening 101, and the access opening 101 may provide an access channel for the spare blades 3, thereby improving efficiency of blade replacement. The access opening 101 may be specifically formed in a rear wall of the rear end of the main body 1. In other embodiments, the access opening 101 may also be formed in a side wall or a top wall e of the rear end of the main body 1.

Referring to FIGS. 1-4, in some embodiments, the scraper may further include a cover 4. The cover 4 may cover the access opening 101, and the spare blades 3 may be prevented from leaving the receiving cavity 10*a* through the access opening 101 by covering the access opening 101 with the cover 4. Specifically, the cover 4 may include a hinge portion 40 and an engagement portion 41. The hinge portion 40 may be hinged to the main body 1, the engagement portion 41 may rotate about the hinge portion 40, and the rear end of the main body 1 may define an engagement groove 103 matched with the engagement portion 41. Each of the hinge portion 40 and the engagement portion 41 may be arranged at a respective one of two ends of a same side of the cover 4, the hinge portion 40 may protrude and extend from the cover 4, and a recess may be formed at the rear end of the main body 1 to accommodate the hinge portion 40, so that the hinge portion 40 may be hinged to the main body 1. The engagement portion 41 may have an inverted hook, the engagement groove 103 may be formed at the rear end of the main body 1, and the inverted hook may be engaged in the engagement groove 103. Edges of the main body 1 for forming the engagement groove 103 may be rounded to facilitate the engagement portion 41 to be engaged in or disengaged from the engagement groove 103. It should also be noted that the hinge portion 40 may include a connecting arm 400 protruding and extending from the cover 4, and the connecting arm 400 may define a connecting through hole 401. The main body 1 may be arranged with a shaft rod 15, the shaft rod 15 may be arranged in the recess at the rear end of the main body 1, and the shaft rod 15 may be rotatably connected to the connecting arm 400 via the connecting through hole 401. A height of the recess may be approximately the same as a thickness of the connecting arm 400, so that the connecting arm 400 may not shake in a thickness direction of the connecting arm 400 when hinged in the recess, thereby improving connection stability at this position.

Figure 2:
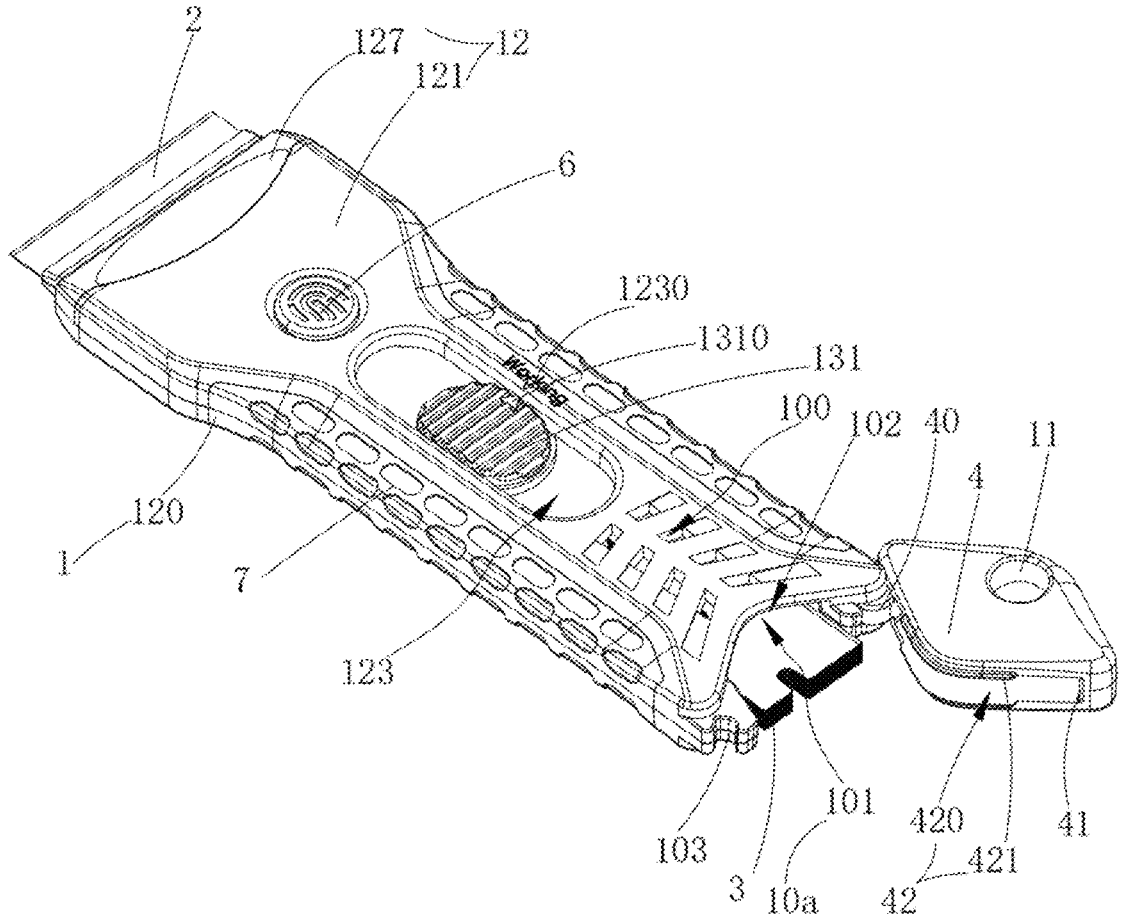
FIG. 2 is a second schematic view of the overall structure of the scraper according to some embodiments of the present disclosure.
Figure 3:
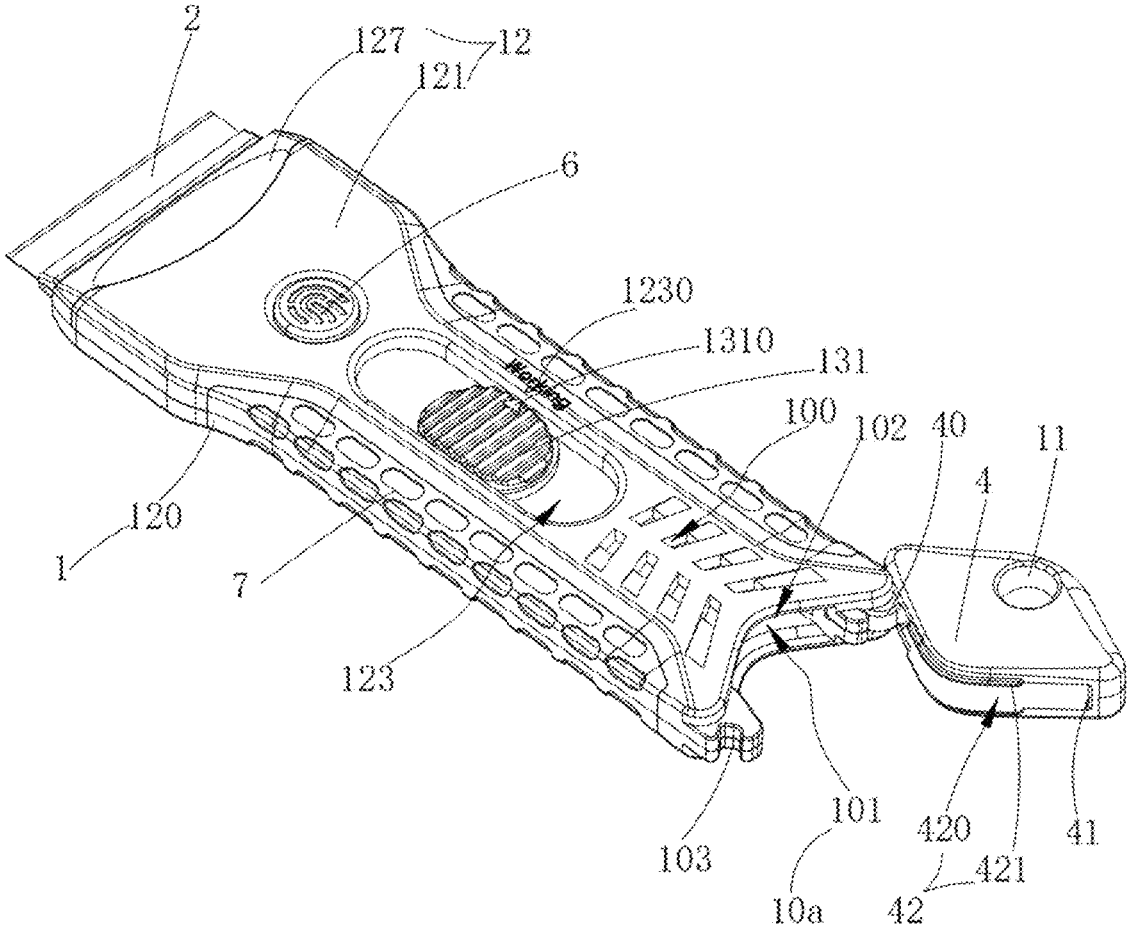
FIG. 3 is a third schematic view of the overall structure of the scraper according to some embodiments of the present disclosure.

Referring to FIGS. 2 and 3, in some embodiments, the main body 1 may define an operation notch 102 at the access opening 101, and the spare blade 3 may partially extend out of the receiving cavity 10*a* through the operation notch 102. Specifically, the main body 1 may be recessed toward a direction close to a front end of the main body 1 to for the operation notch 102. The cover 4 may include a protruding portion 42 that may be matched with the operation notch 102. After the cover 4 may be opened, a portion of the spare blade 3 may be exposed through the operation notch 102 to facilitate the user to take. The protruding portion 42 may enable the spare blade 3 not to be exposed after the cover 4 closes the access opening 101, making an overall structure of the scraper more compact. In order to avoid the protruding portion 42 from squeezing the spare blade 3, a receiving groove 420 may be formed in the protruding portion 42. When the cover 4 covers the access opening 101, the protruding portion 42 may be embedded in the operation notch 102, and the spare blade 3 may be partially placed in the receiving groove 420. In addition, the protruding portion 42 may further include two guiding strips 421, each of the guiding strips 421 may extend along an opening of the receiving groove 420, and the two guiding strips 421 may be symmetrically distributed on both sides of the opening of the receiving groove 420. When the cover 4 covers the access opening 101, the two guiding strips 421 may be embedded in the receiving cavity 10*a* through the access opening 101, and each of the two guiding strips 421 may be tightly engaged with an inner wall of the main body 1 for forming the receiving cavity 10*a*, further improving stability of the cover 4 after covering the access opening 101.

Referring to FIG. 1, in some embodiments, a hanging through hole 11 may be formed in the main body 1 or the cover 4. Specifically, the hanging through hole 11 may be formed in the cover 4, and the scraper may be carried with a hanging rope or hung on a wall nail through the hanging through hole 11.

Figure 4:
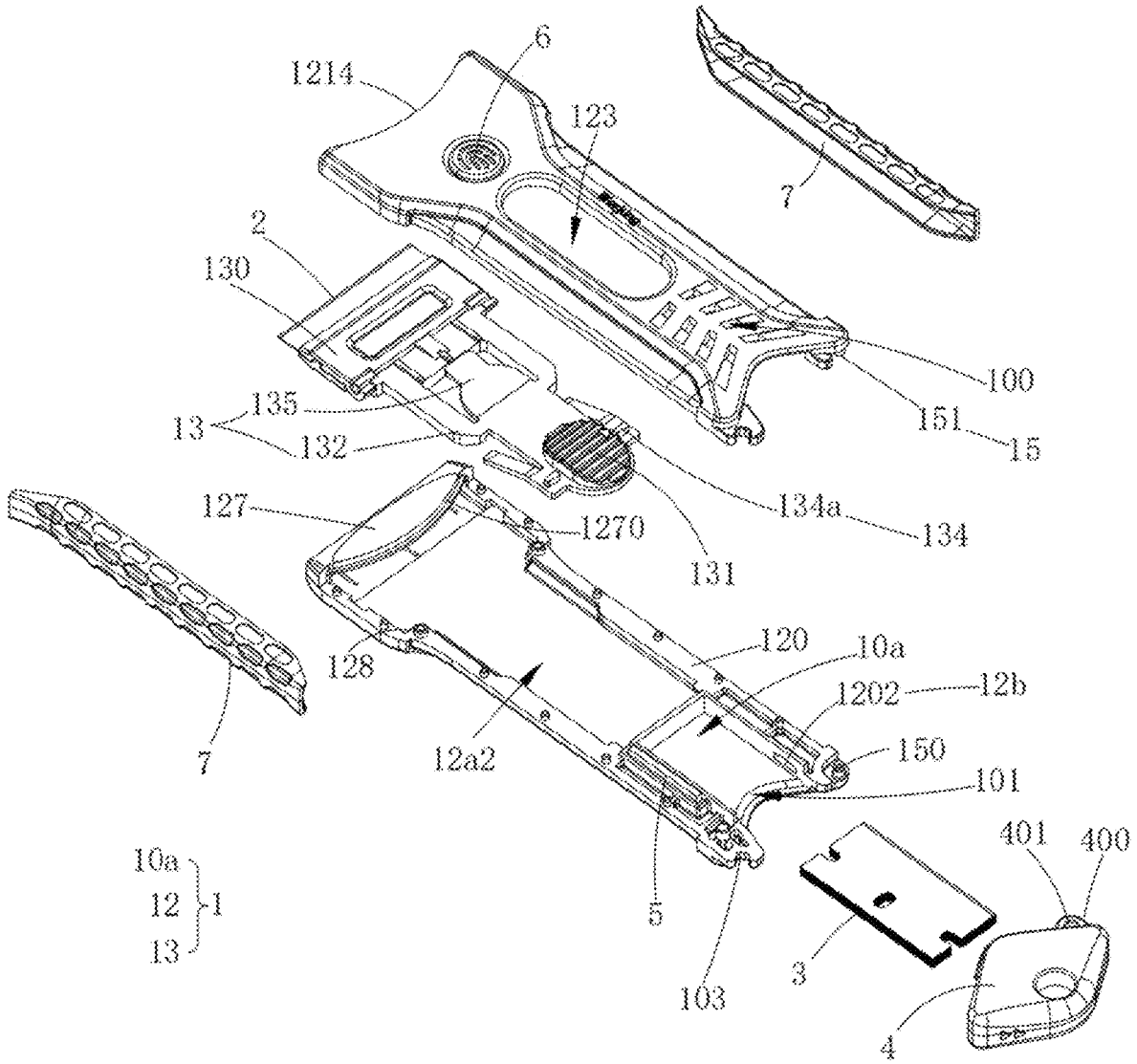
FIG. 4 is an exploded view of the scraper according to some embodiments of the present disclosure.

Referring to FIG. 4, in some embodiments, the scraper may further include at least one magnetic member 5, and the at least one magnetic member 5 may be mounted in the main body 1 and may attract the spare blades 3 in the receiving cavity 10*a*. Specifically, the magnetic member 5 may be arranged on a side wall of the main body 1 for forming the receiving cavity 10*a* or close to the side wall. By attracting the spare blades 3 in the receiving cavity 10*a* through the magnetic member 5, it can prevent the spare blades 3 from being taken out of the receiving cavity 10*a* when the cover 4 is opened. In addition, the thickness direction of the receiving cavity 10*a* may be the same as a thickness direction of the spare blade 3, and the magnetic member 5 may be arranged close to a wall face for forming the receiving cavity 10*a* in the thickness direction of the receiving cavity 10*a*, so that adjacent spare blades 3 may be separated from each other due to magnetic moment, making it convenient for the user to take. It should be noted that a plurality of magnetic members 5 may be arranged close to the receiving cavity 10*a* to increase an attraction force of the magnetic members 5 on the spare blades 3. The magnetic member 5 may specifically be a member with magnetism such as a magnet, electromagnet, or soft magnetic strip.

Referring to FIGS. 4, 5, 7, and 8, in some embodiments, the main body 1 may include a shell 12 and a connecting member 13. The receiving cavity 10*a* may be formed in the shell 12. The shell 12 may further define a mounting cavity 12*a* extending along a length direction of the shell 12, and the mounting cavity 12*a* may have an inlet/outlet 122. The connecting member 13 may be slidably mounted in the mounting cavity 12*a*. The connecting member 13 may include a mounting portion 130 for mounting the working blade 2. The working blade 2 may partially extend out of the mounting cavity 12*a* or be retracted in the mounting cavity 12*a* through the inlet/outlet 122. Specifically, the shell 12 may include a bottom shell body 120 and a top shell body 121, and the bottom shell body 120 and the top shell body 121 may be engaged with each other to cooperatively form the receiving cavity 10*a* and the mounting cavity 12*a*. The receiving cavity 10*a* may be located at a rear end of the shell 12, and the access opening 101 may be formed in a rear end wall of the shell 12. The mounting cavity 12*a*, as a main cavity in the shell 12, may provide a mounting and movement space for the connecting member 13 and storage space for the working blade 2. The inlet/outlet 122 of the mounting cavity 12*a* may be formed in a front end wall of the shell 12. The connecting member 13 may slide in the mounting cavity 12*a* and may have a retracted position, a working position, and a replacement position. When the connecting member 13 is in the retracted position, the working blade 2 may be completely retracted in the mounting cavity 12*a*, and the scraper may be in a retracted state. When the connecting member 13 is in the working position, the working blade 2 may partially extend out of the mounting cavity 12*a* through the inlet/outlet 122, and the scraper may be in a working state. When the connecting member 13 is in the replacement position, the working blade 2 and the mounting portion 130 both extend out of the mounting cavity 12*a* through the inlet/outlet 122, and the scraper may be in a blade-replaceable state, allowing the user to remove the working blade 2 from the mounting portion 130 and take a spare blade 3 from the receiving cavity 10*a* to mount on the mounting portion 130.

It should be noted that the shell 12 may include a first inner wall 12*a*1 and a second inner wall 12*a*2 that may cooperatively form the mounting cavity 12*a* and may be arranged opposite each other. The first inner wall 12*a*1 may be formed by the top shell body 121, the second inner wall 12*a*2 may be formed by the bottom shell body 120, and the connecting member 13 may be located between the first inner wall 12*a*1 and the second inner wall 12*a*2.

Figure 7:
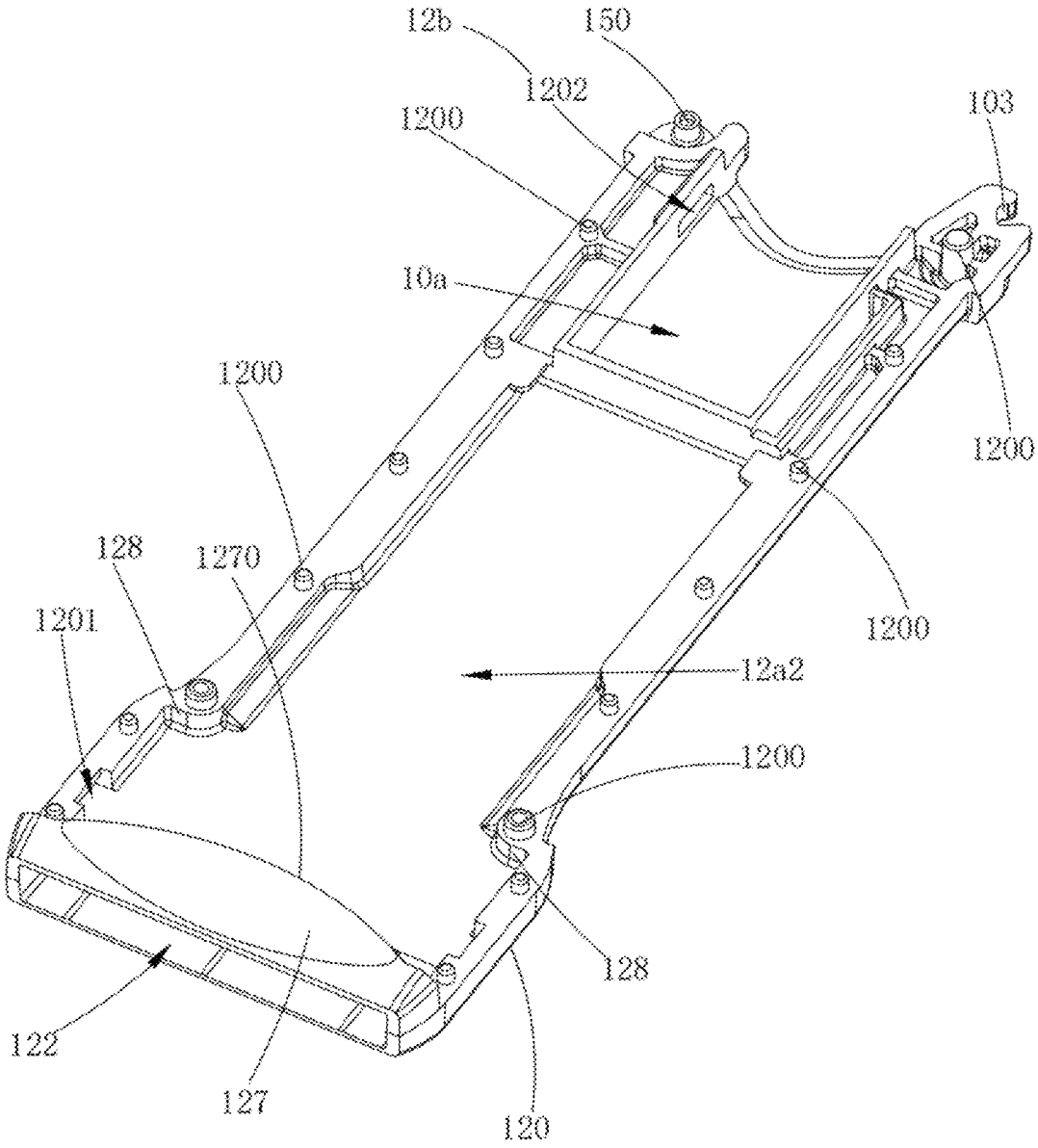
FIG. 7 is a structural view of a bottom shell body according to some embodiments of the present disclosure.
Figure 8:
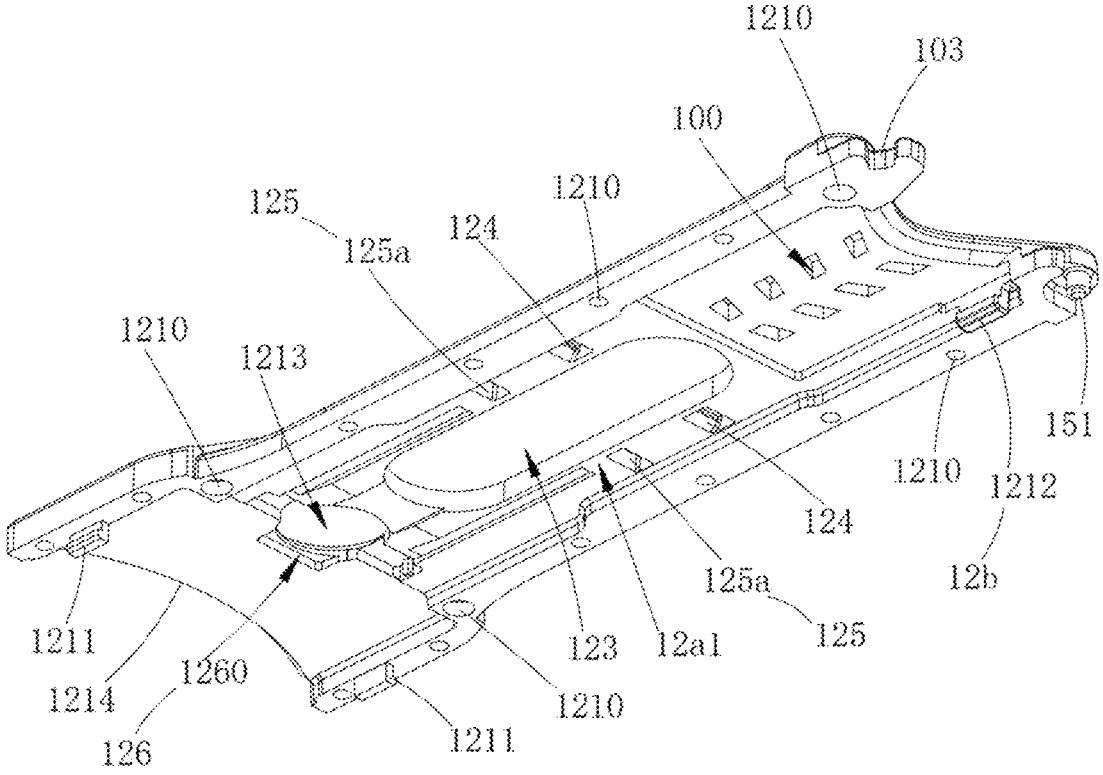
FIG. 8 is a structural view of a top shell body according to some embodiments of the present disclosure.

Referring to FIGS. 7 and 8, each of the bottom shell body 120 and the top shell body 121 may be an elongated, flat plate-like structure. The shell 12 may include a connecting bridge 127, and the connecting bridge 127 may be integrally formed at a front end of the bottom shell body 120. The connecting bridge 127 and a bottom wall of the bottom shell body 120 may cooperatively define the inlet/outlet 122. The connecting bridge 127 may include an exposed end wall and a limiting end wall 1270 in a length direction of the bottom shell body 120, an exposed face of the connecting bridge 127 may be flush with a front end face of the bottom shell body 120, and the limiting end wall 1270 may face a rear end of the bottom shell body 120. The top shell body 121 may have a front end wall 1214. When the top shell body 121 is engaged with the bottom shell body 120, the front end wall 1214 may abut against the limiting end wall 1270, a rear end of the top shell body 121 may be flush with the rear end of the bottom shell body 120 to cooperatively form the access opening 101. It should also be noted that a thickness of the connecting bridge 127 may be approximately the same as a thickness of the top shell body 121, so that after the top shell body 121 is engaged with the bottom shell body 120, the top shell body 121 and the connecting bridge 127 may cooperatively form a smooth face. During use, the bottom shell body 120 may face a cleaning face M, and the working blade 2 may extend out of the mounting cavity 12*a* through the inlet/outlet 122. When the user holds the shell 12 and uses the working blade 2 to clean the cleaning face M, a reaction force F from the cleaning face M to the working blade 2 may be transmitted to the connecting bridge 127, making the limiting end wall 1270 and the front end wall 1214 of the top shell body 121 abut against each other more tightly, enhancing connection firmness between the top shell body 121 and the bottom shell body 120 during use, and avoiding cracks or breaks at a connection position between the bottom shell body 120 and the top shell body 121 during use.

Referring to FIGS. 7 and 8, in some embodiments, the bottom shell body 120 may be arranged with a plurality of fastening positioning protrusions 1200, and the plurality of fastening positioning protrusions 1200 may be evenly distributed along an edge of the bottom shell body 120. The top shell body 121 may correspondingly define a plurality of fastening positioning recesses 1210 corresponding to the plurality of fastening positioning protrusions 1200. When the top shell body 121 covers the bottom shell body 120, the plurality of fastening positioning protrusions 1200 may be engaged in the plurality of fastening positioning recesses 1210 in a one-to-one correspondence, so that the top shell body 121 and the bottom shell body 120 may not be misaligned in the length direction of the shell 12 and a width direction of the shell 12. The engagement between each of the fastening positioning recesses 1210 and a respective one of the fastening positioning protrusions 1200 makes it difficult for the top shell body 121 and the bottom shell body 120 to be separated from each other in a thickness direction of the shell 12. It should also be noted that an outer diameter of each of the fastening positioning protrusions 1200 distributed at four corners of the bottom shell body 120 may be arranged larger, and the fastening positioning recesses 1210 corresponding to the four corners of the top shell body 121 may be adaptively adjusted accordingly. The plurality of fastening positioning protrusions 1200 with larger outer diameters and corresponding fastening positioning recesses 1210 may serve functions of positioning and basic engagement, while the remaining fastening positioning protrusions 1200 with smaller outer diameters and corresponding fastening positioning recesses 1210 may serve a function of auxiliary reinforcement engagement.

Referring to FIGS. 7 and 8, in some embodiments, a front end of the top shell body 121 may be arranged with two engagement hooks 1211, and the two engagement hooks 1211 may be symmetrically distributed along a width direction of the top shell body 121. The bottom shell body 120 may define two hook recesses 1201 in a one-to-one correspondence with the two engagement hooks 1211, and the two hook recesses 1201 may be formed close to the connecting bridge 127. When the top shell body 121 covers the bottom shell body 120, each of the two engagement hooks 1211 may be inserted in a respective one of the two hook recesses 1201, and the two engagement hooks 1211 may be tightly engaged in the two hook recesses 1201, thereby enhancing the connection firmness between the top shell body 121 and the bottom shell body 120 in the thickness direction of the shell 12. In other embodiments, the front end of the top shell body 121 may be arranged with more than two engagement hooks 1211, and correspondingly the bottom shell body 120 may define more than two hook recesses 1201.

Referring to FIGS. 7 and 8, in some embodiments, the rear end of the top shell body 121 may be arranged with at least one locking hook 1212, and the bottom shell body 120 may correspondingly define at least one locking groove 1202 corresponding to the at least one locking hook 1212. When the top shell body 121 covers the bottom shell body 120, the locking hook 1212 may be inserted in the locking groove 1202, and the locking hook 1212 may be tightly engaged in the locking groove 1202, further enhancing the connection firmness between the top shell body 121 and the bottom shell body 120 in the thickness direction of the shell 12, and making the engagement between various parts of the top shell body 121 and the bottom shell body 120 more stable, and hinge stability between the cover 4 and the rear end of the main body 1 higher.

It should also be noted that, in other embodiments, the engagement hooks 1211 and the locking hooks 1212 may be arranged on the bottom shell body 120, and the hook recesses 1201 and the locking grooves 1202 may be correspondingly formed in the top shell body 121.

In order to further improve the connection firmness between the bottom shell body 120 and the top shell body 121 and enhance the user's grip feel, in some embodiments, the scraper may further include two soft rubber sleeves 7. As shown in FIGS. 3 and 4, the two soft rubber sleeves 7 may be symmetrically arranged on both sides of the shell 12, and each of the soft rubber sleeves 7 may simultaneously wrap the bottom shell body 120 and the top shell body 121, improving the connection firmness between the bottom shell body 120 and the top shell body 121 in the thickness direction of the shell 12. Each of the soft rubber sleeves 7 may extend from the front end of the shell 12 to the rear end of the shell 12, which may not only improve the connection stability between the bottom shell body 120 and the top shell body 121 but also avoid cracks between the bottom shell body 120 and the top shell body 121 in the length direction of the shell 12. Each of the soft rubber sleeves 7 may be fixed to corresponding position of the shell 12 by hot melting. A soft rubber characteristic of the soft rubber sleeves 7 may reduce a damage to the user's palm caused by the shell 12 when the user holds the scraper for a long time. Moreover, anti-slip patterns may be formed on the soft rubber sleeves 7 to increase friction between the user's palm and the soft rubber sleeves 7, allowing the user to hold the scraper stably.

Referring to FIGS. 4, 7, and 8, in some embodiments, the shaft rod 15 may include a positioning shaft 150 arranged on the bottom shell body 120 and an insertion rod 151 arranged on the top shell body 121, and the insertion rod 151 may be coaxially connected to the positioning shaft 150. Specifically, an insertion hole may be formed in an end wall of the positioning shaft 150 for the insertion rod 151 to be inserted in. During mounting the scraper, the connecting arm 400 of the cover 4 may be sleeved on the positioning shaft 150 via the connecting through hole 401, and then the insertion rod 151 of the top shell body 121 may be inserted in the connecting through hole 401, and then inserted in and connected to the positioning shaft 150, thereby hinging the cover 4 to the shell 12. In some embodiments, the locking hook 1212 and the locking groove 1202 may cooperatively form a shaft reinforcement portion 12*b*, and the shaft reinforcement portion 12*b* may be arranged close to the shaft rod 15. The top shell body 121 and the bottom shell body 120 may be connected to each other through the shaft reinforcement portion 12*b* to improve the connection stability between the top shell body 121 and the bottom shell body 120. Specifically, the locking hook 1212 may be arranged close to the hinge portion 40 of the cover 4, and the locking groove 1202 may be formed in a wall of the bottom shell body 120 for forming the receiving cavity 10*a*. The engagement between the locking hook 1212 and the locking groove 1202 may improve connection stability between the rear end of the bottom shell body 120 and the rear end of the top shell body 121. In addition, the cover 4 may inevitably be subjected to forces in the thickness direction of the cover 4 during opening and closing the receiving cavity 10*a*, which may easily cause cracks near the cover 4 between the bottom shell body 120 and the top shell body 121, and the insertion rod 151 may be prone to be detached from the positioning shaft 150 and the connecting through hole 401. While the locking hook 1212 and the locking groove 1202 may be located close to the hinge portion 40, realizing an axial limitation on the insertion rod 151 and the positioning shaft 150, making it difficult for the insertion rod 151 and the positioning shaft 150 to be axially separated from each other, thereby improving connection stability between the cover 4 and the main body 1. In other embodiments, a plurality of locking hooks 1212 and a plurality of locking grooves 1202 may be provided, and the plurality of locking hooks 1212 may be correspondingly distributed on various positions of the rear end of the top shell body 121 that may be prone to cracking as needed.

Figure 9:
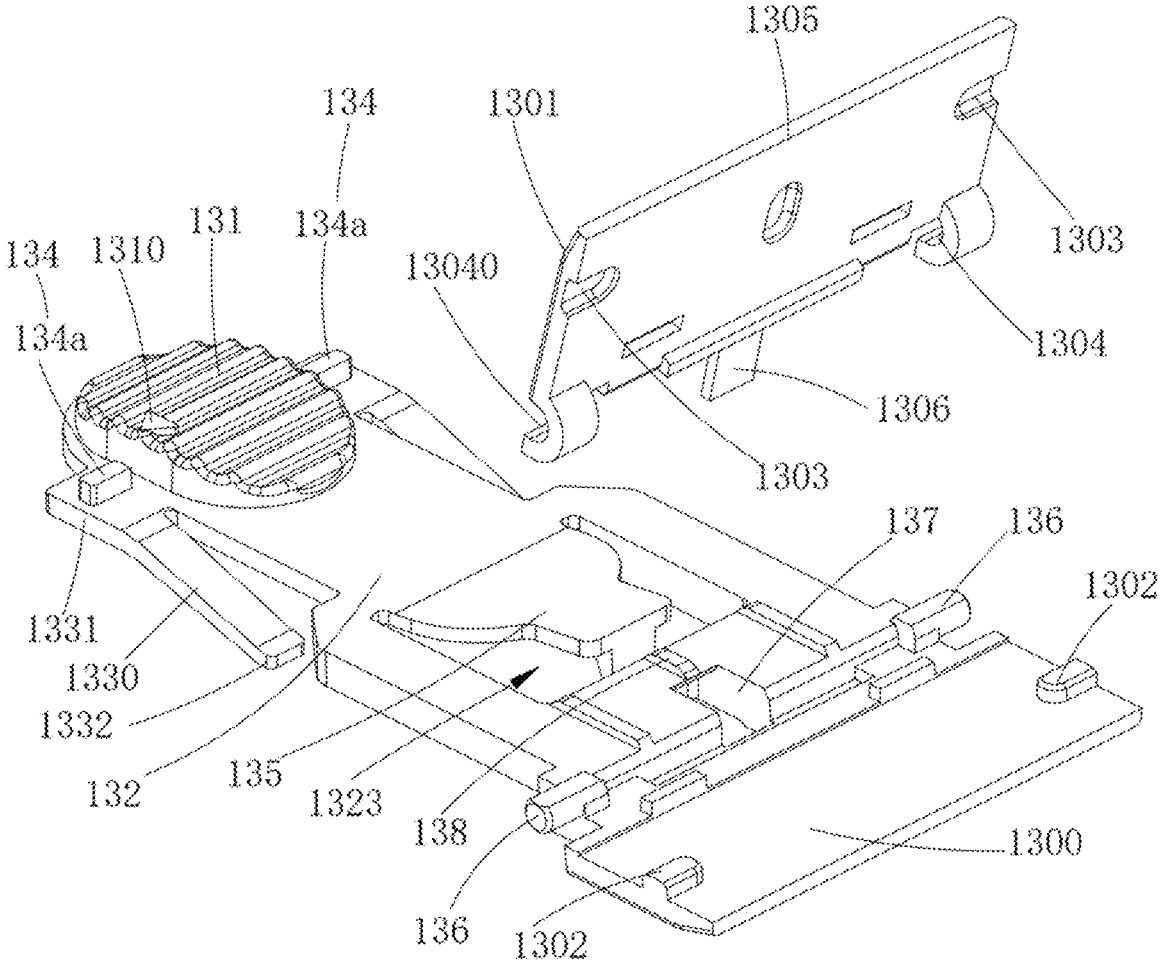
FIG. 9 is a first structural view of the connecting member according to some embodiments of the present disclosure.
Figure 10:
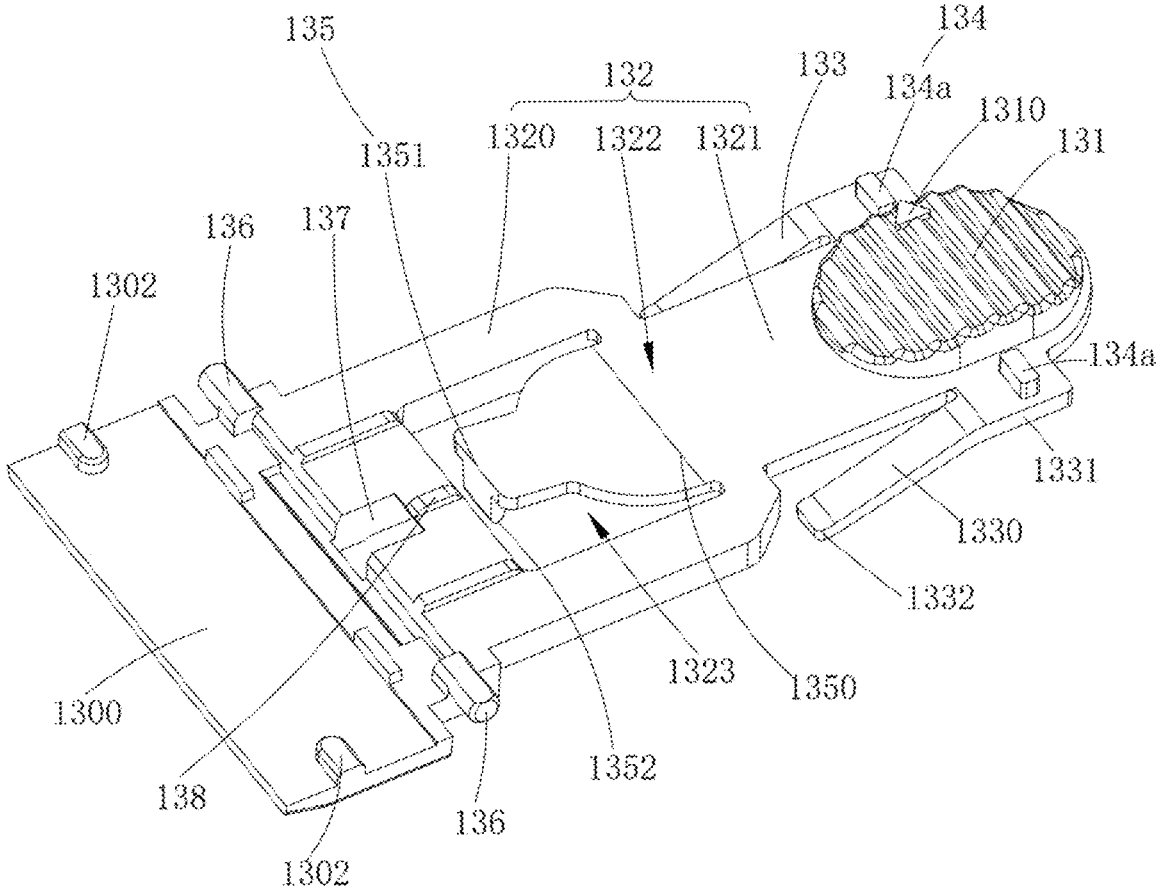
FIG. 10 is a second structural view of the connecting member according to some embodiments of the present disclosure.

It should be noted that the working blade 2 and the spare blade 3 have the same structure. For convenience of description, both the working blade 2 and the spare blade 3 are collectively referred to as a blade hereinafter. In some embodiments, to facilitate blade replacement, the mounting portion 130 may include a fixed plate 1300 and a movable plate 1301. As shown in FIGS. 9 and 10, the fixed plate 1300 may be integrally formed with the connecting member 13 as a one-piece structure. The fixed plate 1300 may be arranged with a plurality of clamping protrusions 1302 to restrict sliding of the blade. The movable plate 1301 may define a plurality of clamping holes 1303 corresponding to the clamping protrusions 1302. The movable plate 1301 may define hinge holes 1304 and include a free end 1305. The movable plate 1301 may be hinged to the connecting member 13 via the hinge holes 1304. The free end 1305 may swing around the hinge holes 1304. When the movable plate 1301 is engaged with the fixed plate 1300, the blade may be clamped and fixed under a cooperation of the clamping holes 1303 and the clamping protrusions 1302. Specifically, the hinge holes 1304 may be formed on both sides of the movable plate 1301. The connecting member 13 may be arranged with hinge rods 136, with each hinge rod 136 protruding from a respective one of two sides of the connecting member 13. The hinge rods 136 may be rotatably connected to the movable plate 1301 via the hinge holes 1304, allowing the free end 1305 of the movable plate 1301 to swing about a hinge axis of the movable plate 1301. To facilitate the assembly of the movable plate 1301 and the hinge rods 136, a hole wall of the movable plate 1301 for forming each hinge hole 1304 may define an insertion notch 13040 along the axial direction of the movable plate 1301. Applying a radial force to the hinge rod 136 may enable the hinge rod 136 to enter or leave a corresponding hinge hole 1304 radially through the insertion notch 13040. When no radial force is applied to the hinge rod 136, the hinge rod 136 may not be detached from the corresponding hinge hole 1304 through the insertion notch 13040, allowing the hinge rod 136 to rotate in the corresponding hinge hole 1304. The clamping protrusions 1302 on these fixed plate 1300 may be arranged to correspond to hole positions in the blade. The blade may be of a conventional structure, and isn't elaborated in this embodiment. The blade replacement method may be as follows. When the scraper is in the blade-replaceable state, the free end 1305 of the movable plate 1301 may be pulled to swing the movable plate 1301, thereby removing the blade from the fixed plate 1300. A new blade may be then placed on the clamping protrusions 1302 on the fixed plate 1300, and finally be clamped and fixed by the movable plate 1301 and the fixed plate 1300.

Figure 6:
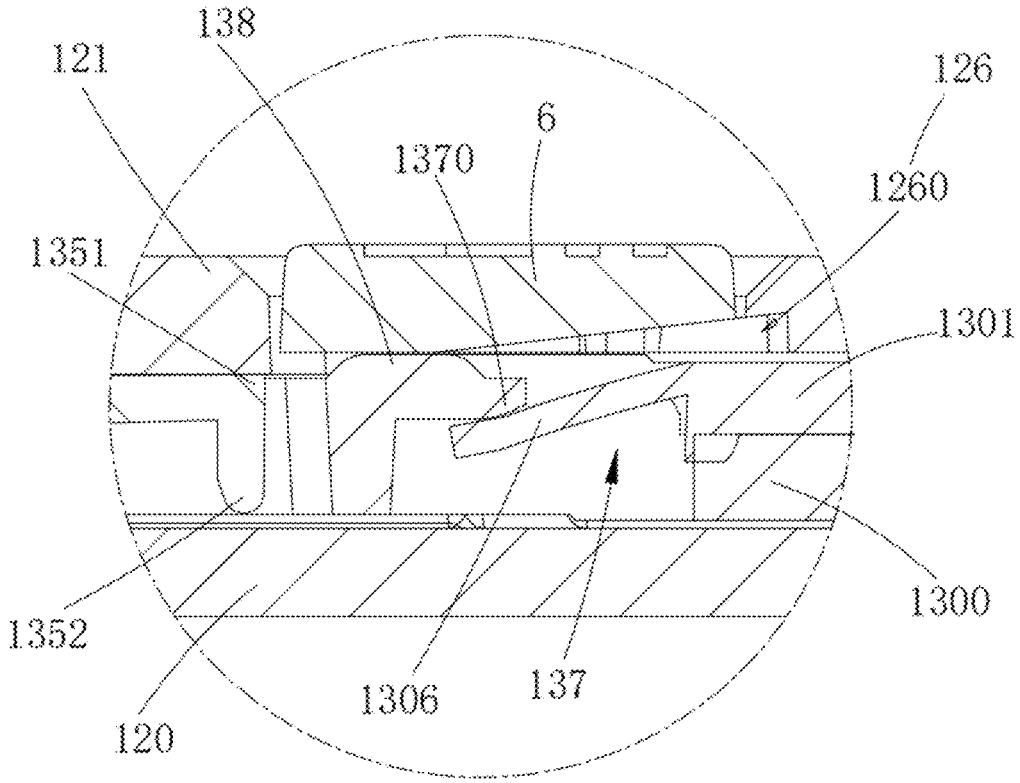
FIG. 6 is an enlarged view of a portion A in FIG. 5.

Referring to FIGS. 6 and 9, in some embodiments, the mounting portion 130 may further include a reset plate 1306. The reset plate 1306 may be located on a side of the movable plate 1301 away from the free end 1305 and may extend in a direction away from the free end 1305. Each of the reset plate 1306 and the free end 1305 may be arranged on a respective one of two opposite sides of the hinge holes 1304. The connecting member 13 may define an avoidance through hole 137 and may include a force-bearing protrusion 1370. The avoidance through hole 137 may be formed close to the fixed plate 1300, and the force-bearing protrusion 1370 may be arranged in the avoidance through hole 137 and may extend radially from an inner wall of the connecting member 13 for forming the avoidance through hole 137. When the movable plate 1301 is hinged to the connecting member 13, the reset plate 1306 may be inserted in the avoidance through hole 137, and an end portion of the reset plate 1306 may abut against a side of the force-bearing protrusion 1370 facing the bottom shell body 120. Specifically, when the movable plate 1301 is engaged with the fixed plate 1300, the reset plate 1306 may abut against the force-bearing protrusion 1370, causing the force-bearing protrusion 1370 to undergo an elastic deformation. By applying an external force to pull the free end 1305 of the movable plate 1301, the clamping protrusions 1302 may be disengaged from the clamping holes 1303. At this time, an elastic force generated by the elastic deformation of the force-bearing protrusion 1370 may drive the free end 1305 to quickly move away from the fixed plate 1300. In this way, the blade replacement may be facilitated, as the user may only need to disengage the clamping protrusions 1302 from the clamping holes 1303, and then the movable plate 1301 may naturally spring open, making the blade replacement more convenient for the user.

Referring to FIGS. 9-12, in some embodiments, the connecting member 13 may further include a first button 131 and a connection body 132. The connection body 132 may be connected with the mounting portion 130 and the first button 131. The shell 12 may define a guiding hole 123, and the mounting cavity 12*a* and an exterior of the shell 12 may be communicated with each other via the guiding hole 123. The guiding hole 123 may extend along a length direction of the mounting cavity 12*a*. The first button 131 may be at least partially arranged in the guiding hole 123. Specifically, the guiding hole 123 may be formed in the top shell body 121. An outer contour of the connection body 132 may be roughly the same as an inner contour of the mounting cavity 12*a*, improving sliding stability of the connection body 132 in the mounting cavity 12*a*. Each of the first button 131 and the mounting portion 130 may be arranged on a respective one of two opposite ends of the connection body 132. The first button 131 may be a structure protruding from the connection body 132. The user may press and push the first button 131 through the guiding hole 123, causing the connection body 132 to slide in the mounting cavity 12*a*, thereby allowing the working blade 2 on the mounting portion 130 to extend out of or retract in the mounting cavity 12*a*, or fully extend out of the mounting cavity 12*a* for replacement. It should also be noted that an outer face of the shell 12 may be further arranged with a working state indicator 1230. The working state indicator 1230 may be arranged close to the guiding hole 123. A surface of the first button 131 may be arranged with an indicator arrow 1310. The indicator arrow 1310 pointing to the working state indicator 1230 may indicate that the connecting member 13 may have been pushed to a designated working position, and the scraper may be in the working state.

Figure 11:
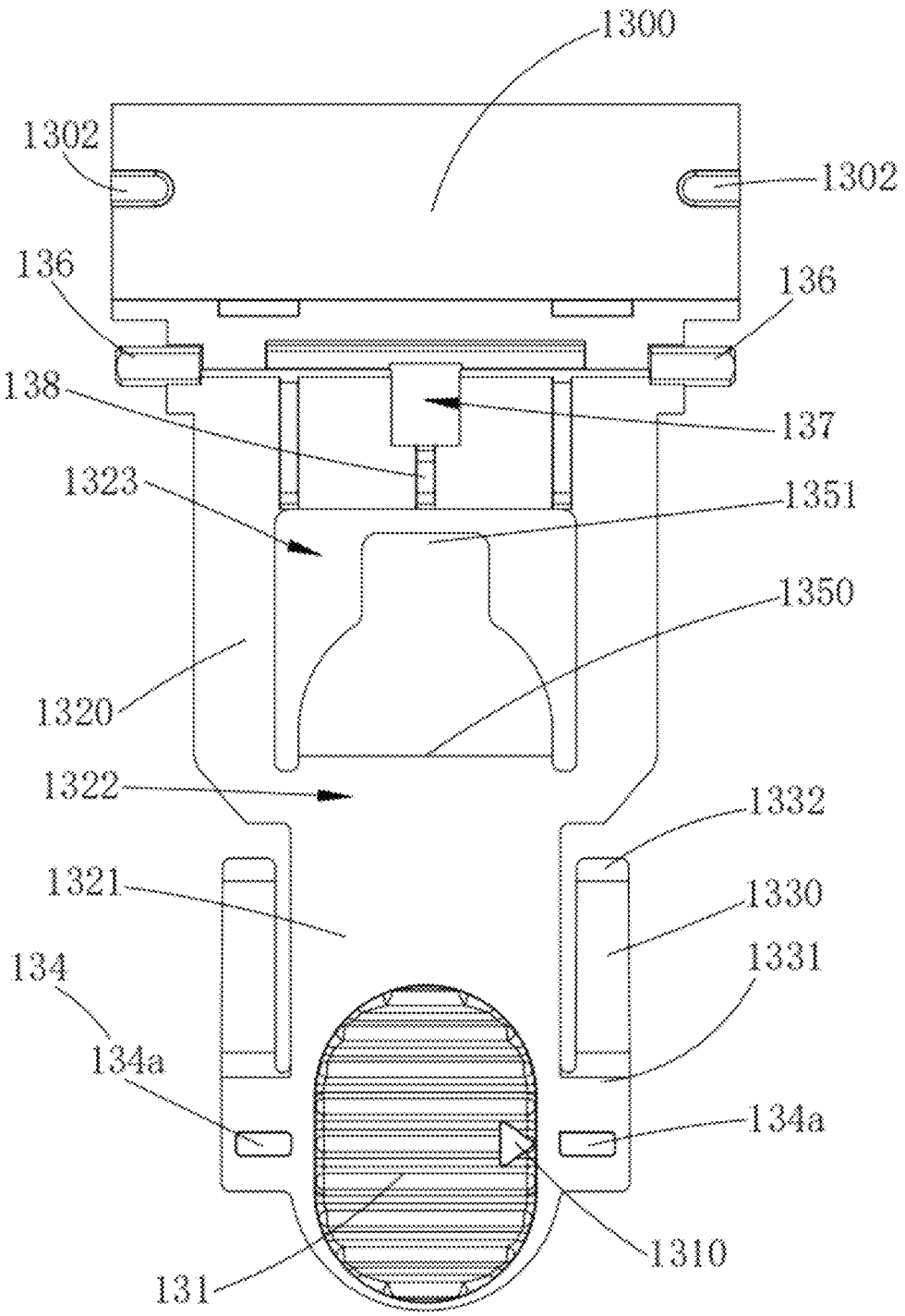
FIG. 11 is a first front projection view of the connecting member according to some embodiments of the present disclosure.
Figure 12:
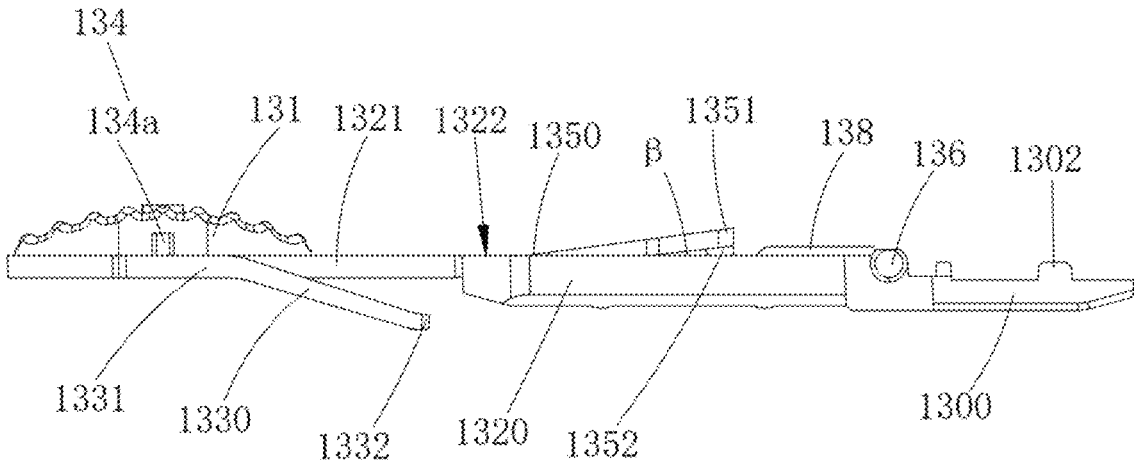
FIG. 12 is a second front projection view of the connecting member according to some embodiments of the present disclosure.

Referring to FIGS. 10, 11, and 12, in some embodiments, the connecting member 13 may further include an elastic support portion 133 and a cooperating portion 134. In some embodiments, the cooperating portion 134 may include a limiting protrusion 134*a*. The elastic support portion 133 may be located on a side of the connection body 132 away from the guiding hole 123, and the connection body 132 may be supported by the elastic support portion 133. The limiting protrusion 134*a* may be located on a side of the connection body 132 close to the guiding hole 123. The shell 12 may further define a first limiting recess 124 and include a locking portion 125. In some embodiments, when the working blade 2 extends out of the mounting cavity 12*a* to the working position, the locking portion 125 may be engaged with the cooperating portion 134 to restrict a relative position between the connecting member 13 and the shell 12. Specifically, the locking portion 125 may include a locking recess 125*a*, and the limiting protrusion 134*a* may be engaged in the locking recess 125*a*. Specifically, each of the first limiting recess 124 and the locking recess 125*a* may be formed in the first inner wall 12*a*1, and the first limiting recess 124 and the locking recess 125*a* may be spaced apart from each other along a sliding direction of the connecting member 13. The elastic support portion 133 may abut against the second inner wall 12*a*2 to elastically support the connection body 132. An elastic force of the elastic support portion 133 may drive the limiting protrusion 134*a* to be engaged in the first limiting recess 124 or the locking recess 125*a*. Pressing the first button 131 may enable the limiting protrusion 134*a* to be disengaged from the first limiting recess 124 or the locking recess 125*a*.

Figure 15:
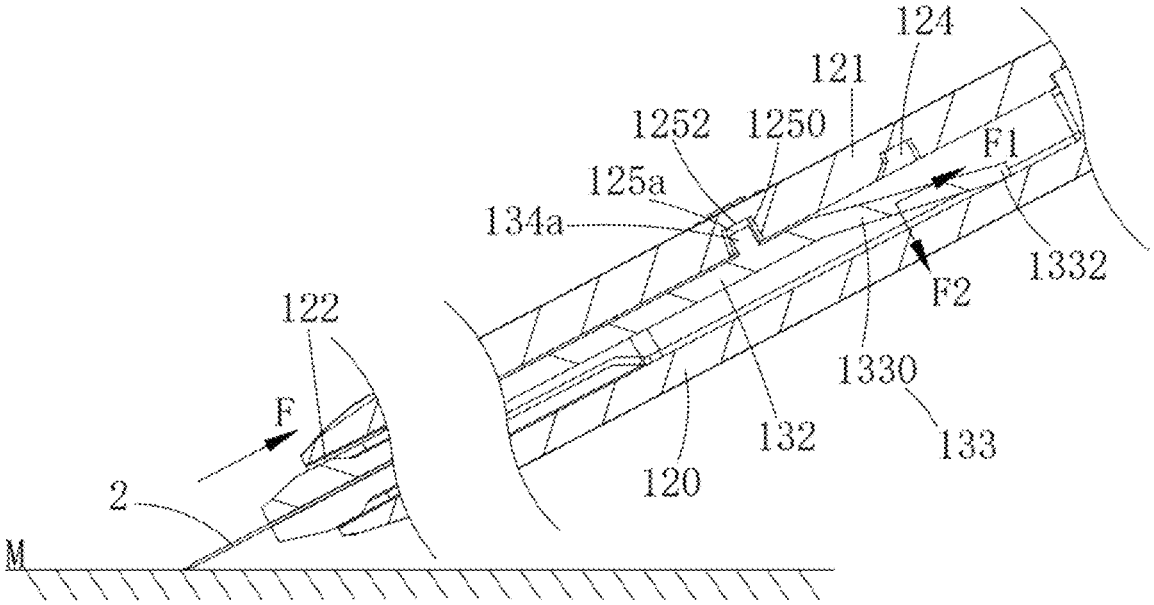
FIG. 15 is a cross-sectional view of a partial structure of the scraper according to some embodiments of the present disclosure, showing a force condition of an elastic support leg in a case where the elastic support leg is inclined away from the inlet/outlet.

Since the mounting cavity 12*a* is formed by an engagement of the bottom shell body 120 and the top shell body 121, the guiding hole 123, first limiting recess 124, and locking recess 125*a* may be specifically formed in the top shell body 121. The elastic support portion 133 may support the connection body 132 by abut against the bottom shell body 120. The elastic support portion 133 may be specifically implemented as a support leg 1330, as shown in FIG. 12 or 15. The support leg 1330 may extend from the connection body 132 at an inclined angle, naturally providing a support to the connection body 132 and causing the connection body 132 to maintain a cantilevered state with elastic action. In other embodiments, the elastic support portion 133 may also be implemented as a spring, elastic rubber, or other elastic reset structures.

When the first button 131 is pressed, the connection body 132 may move closer to the bottom shell body 120 and compress the elastic support portion 133, causing the limiting protrusion 134*a* to be disengaged from the first limiting recess 124 or the locking recess 125*a*. Pushing the first button 131 then may allow the connection body 132 to slide. When the pressing force on the first button 131 is released, the limiting protrusion 134*a* may be re-engaged in the first limiting recess 124 or the locking recess 125*a* under the elastic force of the elastic support portion 133, keeping the connection body 132 a designated position.

A distance between the first limiting recess 124 and the locking recess 125*a* may be arranged to match a sliding stroke of the connecting member 13 from the retracted position to the working position, the first limiting recess 124 may be located away from the inlet/outlet 122, and the locking recess 125*a* may be located close to the inlet/outlet 122. Specifically, when the connecting member 13 is in the retracted position, the limiting protrusion 134*a* may be engaged in the first limiting recess 124; when the connecting member 13 is in the working position, the limiting protrusion 134*a* may be engaged in the locking recess 125*a*. To improve stability of the connecting member 13, two first limiting recesss 124 and two locking recesses 125*a* may be formed. The two first limiting recesss 124 may be symmetrically distributed on both sides of the guiding hole 123 along a length direction of the guiding hole 123, and the two locking recesses 125*a* may be symmetrically distributed on both sides of the guiding hole 123 along the length direction of the guiding hole 123. Correspondingly, two limiting protrusions 134*a* may be symmetrically arranged on both sides of the first button 131 and centered along a length direction of the first button 131 relative to the first button 131, ensuring that pressing the first button 131 may cause the limiting protrusions 134*a* to move along a pressing direction of the first button 131, facilitating disengagement of the limiting protrusions 134*a* from the first limiting recesss 124 or the locking recesses 125*a*.

Figure 13:
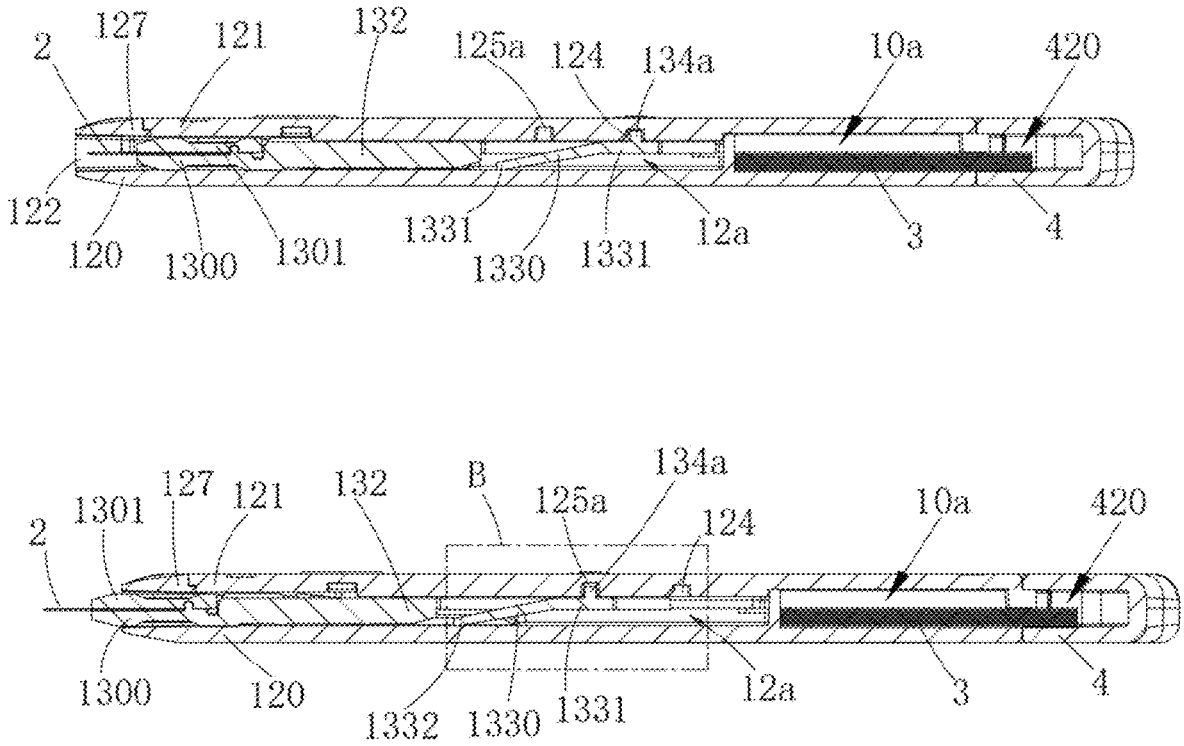
FIG. 13 is a second cross-sectional view of the overall structure of the scraper according to some embodiments of the present disclosure, showing the connecting member in the retracted position and the working position.
Figure 14:
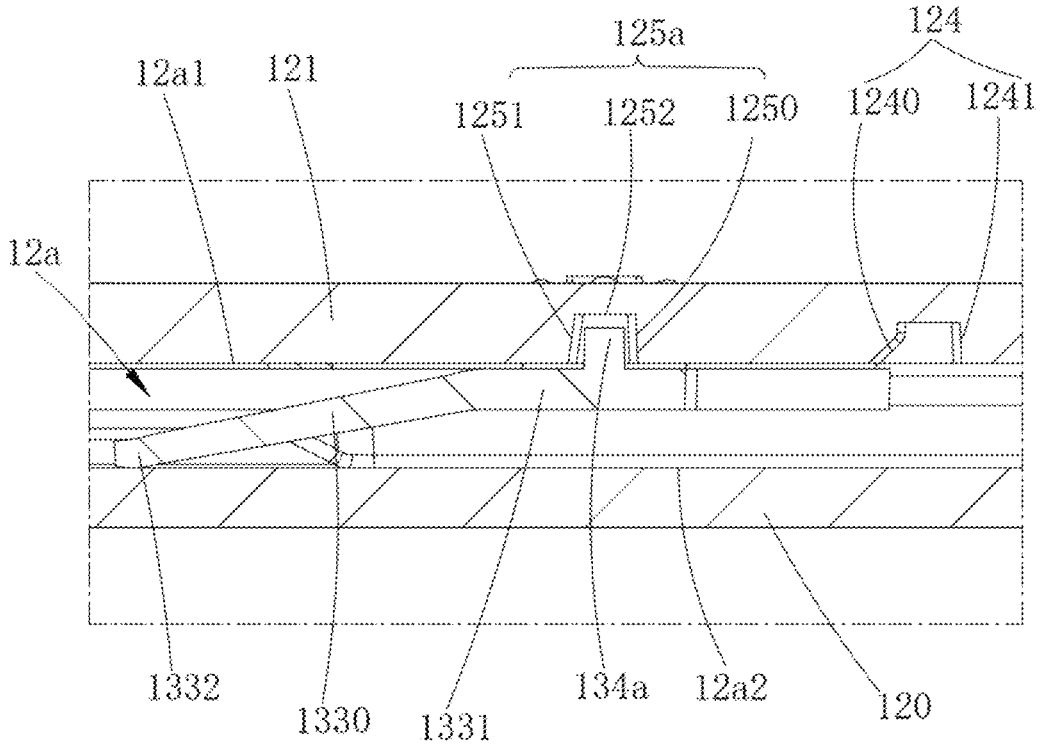
FIG. 14 is an enlarged view of a portion B in FIG. 13.

Referring to FIGS. 13 and 14, when the connecting member 13 is in the retracted position, the scraper may be in a retracted state. To allow quick switching from the retracted state to the working state and improve operational smoothness, the top shell body 121 may include a guiding wall 1240 and a first limiting wall 1241 which are arranged opposite each other and cooperatively define the first limiting recess 124. The guiding wall 1240 may be arranged close to the locking recess 125*a*, while the first limiting wall 1241 may be arranged away from the locking recess 125*a*. The guiding wall 1240 may be an inclined wall, allowing the limiting protrusion 134*a* to be quickly disengaged from the first limiting recess 124 when switching the scraper from the retracted state to the working state. During this process, the user may not need to press the first button 131 to a limit position-only a light press and a push of the first button 131 toward the inlet/outlet 122 may be required to disengage the limiting protrusion 134*a* from the first limiting recess 124. In summary, the guiding wall 1240 may serve as an inclined guide face for the limiting protrusion 134*a* to enter and exit the first limiting recess 124, achieving low-resistance unlocking and enhancing user experience. Conversely, when the connecting member 13 moves from the working position to the retracted position, the guiding wall 1240 may also facilitate a quick entry of the limiting protrusion 134*a* to the first limiting recess 124. The first limiting wall 1241 may be approximately perpendicular to a shell face of the top shell body 121, meaning the first limiting wall 1241 may form a roughly 90-degree angle with a sliding direction of the connecting member 13. The first limiting wall 1241 may naturally act as a physical blocking face of the limiting protrusion 134*a* when the limiting protrusion 134*a* slides away from the inlet/outlet 122. When no external force is applied to the first button 131, the first limiting wall 1241 may serve as a locking mechanism.

Since the working state is a primary usage state of the scraper, to ensure the connecting member 13 may be maintained in the working position, as shown in FIG. 14, in some embodiments, the top shell body 121 may include a second limiting wall 1250 and a third limiting wall 1251 which are arranged opposite each other, and further include a bottom wall 1252 connected with the second limiting wall 1250 and third limiting wall 1251. The second limiting wall 1250, the third limiting wall 1251, and the bottom wall 1252 may cooperatively define the locking recess 125*a*. The bottom wall 1252 may be approximately parallel to the shell face of the top shell body 121. The second limiting wall 1250 may be arranged close to the first limiting recess 124, while the third limiting wall 1251 may be arranged away from the first limiting recess 124. Each of the second limiting wall 1250 and third limiting wall 1251 may be similar to the first limiting wall 1241, being approximately perpendicular to the shell face of the top shell body 121, meaning each of the second limiting wall 1250 and third limiting wall 1251 may form an approximately 90-degree angle with the sliding direction of the connecting member 13. When the limiting protrusion 134*a* is engaged with the locking recess 125*a*, each of the second limiting wall 1250 and third limiting wall 1251 may form a physical blocking face against the sliding of the limiting protrusion 134*a*. When no external force is applied to the first button 131, each of the second limiting wall 1250 and third limiting wall 1251 may serve as a locking mechanism.

Referring to FIGS. 10-16, the elastic support portion 133 may include a support leg 1330, a connecting end 1331, and a contact end 1332. Each of the connecting end 1331 and contact end 1332 may be arranged at a respective one of two ends of the support leg 1330. The support leg 1330 may be obliquely arranged on the connection body 132. The connecting end 1331 may be connected with the connection body 132, and the limiting protrusion 134*a* may be arranged close to the connecting end 1331. Specifically, the limiting protrusion 134*a* may be arranged closer to the connecting end 1331 than the contact end 1332. The contact end 1332 may abut against the second inner wall 12*a*2 for forming the mounting cavity 12*a* to form support. During operation when the scraper is in the working state, the working blade 2 fixed on the mounting portion 130 may contact the cleaning face M and may be subjected to the reaction force F from the cleaning face M. The reaction force F may be transmitted through the fixed plate 1300 to the connection body 132. Depending on different inclination directions of the support leg 1330, the reaction force F at the support leg 1330 may have different effects, thereby differently influencing the support leg 1330 and the limiting protrusion 134*a* formed at the connecting end 1331.

When the elastic support portion 133 adopts the support leg 1330 shown in FIG. 15, the support leg 1330 may extend obliquely away from the inlet/outlet 122, meaning the contact end 1332 may be farther from the inlet/outlet 122 compared to the connecting end 1331. In this case, the support leg 1330 may be subjected to a first component force F1 and a second component force F2 as shown in FIG. 15. The first component force F1 may be directed along an extension direction of the support leg 1330, meaning the first component force F1 may be oriented away from the limiting protrusion 134*a*. The second component force F2 may be directed away from the top shell body 121, meaning the second component force F2 may be in a same direction as pressing the first button 131. An increase in the reaction force F may cause both the first component force F1 and the second component force F2 to increase. When the user pushes the scraper forcefully to make the working blade 2 contact the cleaning face M, excessive reaction force F may cause each of the first component force F1 and the second component force F2 to increase. The increase in the second component force F2 may cause the support leg 1330 to deform away from the top shell body 121, resulting in the limiting protrusion 134*a* originally engaged in the locking recess 125*a* being disengaged from the locking recess 125*a*. The increase in the first component force F1 may further accelerate the disengagement of the limiting protrusion 134*a* from the locking recess 125*a*, causing the locking function of the limiting protrusion 134*a* to fail. Consequently, the working blade 2 may retract into the mounting cavity 12*a* and may not maintain the working state for cleaning, leading to a degraded user experience.

Figure 16:
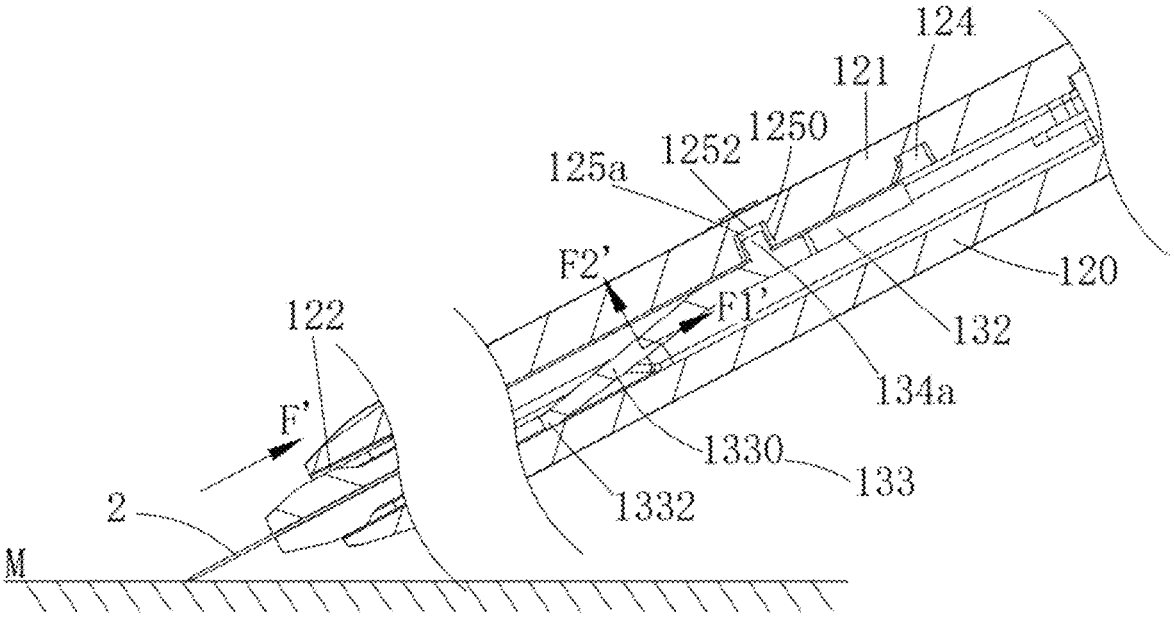
FIG. 16 is a cross-sectional view of the partial structure of the scraper according to some embodiments of the present disclosure, showing a force condition of the elastic support leg in a case where the elastic support leg is inclined towards the inlet/outlet.

Conversely, when the elastic support portion 133 adopts the support leg 1330 shown in FIG. 16, the support leg 1330 may extend obliquely toward the inlet/outlet 122, meaning the contact end 1332 may be closer to the inlet/outlet 122 compared to the connecting end 1331. In this case, the support leg 1330 may be subjected to the first component force F1' and the second component force F2' as shown in FIG. 16. The first component force F1' may be directed opposite to the extension direction of the support leg 1330, meaning the first component force F1' may be oriented toward the limiting protrusion 134*a*. The second component force F2' may be directed toward the top shell body 121, meaning the second component force F2' may be opposite to the direction of pressing the first button 131. An increase in reaction force F' may cause both the first component force F1' and the second component force F2' to increase. When the user pushes the scraper forcefully to make the working blade 2 contact the cleaning face M, excessive reaction force F' may cause the first component force F1' and the second component force F2' to increase. Since the second component force F2' may be opposite to the deformation direction of the support leg 1330 away from the top shell body 121, the increase in the second component force F2' may not cause the support leg 1330 to deform away from the top shell body 121. Meanwhile, since the first component force F1' is directed toward the limiting protrusion 134*a*, and the increase in the first component force F1' may make the limiting protrusion 134*a* press more tightly against the second limiting wall 1250 and bottom wall 1252 of the locking recess 125*a*, thereby preventing the limiting protrusion 134*a* from being disengaged from the locking recess 125*a*, ingeniously converting the reaction force F' into a locking force that may enhance a locking capability of the limiting protrusion 134*a*. As a result, the working blade 2 may be always maintained in the working state for cleaning, improving the user experience when operating the scraper.

It should also be noted that in other embodiments, the cooperating portion 134 may adopt a groove structure while the locking portion 125 may adopt a protrusion structure that may be engaged in the groove structure. Alternatively, each of the cooperating portion 134 and locking portion 125 may adopt the protrusion structure. The specific structures of the aforementioned cooperating portion 134 and locking portion 125 may all be arranged according to the support leg 1330 shown in FIG. 16 to achieve a locking effect of the connecting member 13 in the working position. Moreover, the locking portion 125 may alternatively be formed on an inner wall of the top shell body 121 for forming the mounting cavity 12*a* along a thickness direction of the mounting cavity 12*a* (i.e., on an inner wall other than the first inner wall 12*a*1 and second inner wall 12*a*2), with the cooperating portion 134 correspondingly arranged on the connection body 132 at a position engageable with the locking portion 125.

Referring to FIGS. 3, 5, 6, 8 and 10, in some embodiments, the shell 12 may further include a first limiting portion 126 arranged on the first inner wall 12*a*1 of the top shell body 121 for forming the mounting cavity 12*a*, while the connecting member 13 may further include a second limiting portion 135 cooperated with the first limiting portion 126. When the connecting member 13 slides from the retracted position to the working position, the second limiting portion 135 may be engaged with the first limiting portion 126 to prevent further sliding of the connecting member 13 toward the inlet/outlet 122. At this point, the working blade 2 may partially extend out of the mounting cavity 12*a* through the inlet/outlet 122, placing the scraper in the working state. When a force perpendicular to the sliding direction of the connecting member 13 is applied to at least one of the second limiting portion 135 and first limiting portion 126, the engagement of the second limiting portion 135 and first limiting portion 126 may be released to free the connecting member 13. When the connecting member 13 slides to the replacement position, the scraper may enter the blade-replaceable state.

Specifically, after the second limiting portion 135 is engaged with the first limiting portion 126, since a force perpendicular to the sliding direction of the connecting member 13 needs to be applied to either of the second limiting portion 135 and first limiting portion 126 to release the engagement of the second limiting portion 135 and first limiting portion 126, the user must use one hand to control the sliding of the connecting member 13 while using the other hand to apply the required perpendicular force to release the engagement between the second limiting portion 135 and first limiting portion 126. This arrangement may prevent an accidental direct sliding from the retracted state to the replacement state during one-handed operation, ensuring the working blade 2 may remain securely in the working state during use and avoiding operational errors. In this way, the working blade 2 may be prevented from falling from the scraper during use, thereby improving user experience.

Referring to FIGS. 10-12, in some embodiments, the second limiting portion 135 may include a fixed end 1350 connected to the connection body 132 and a limiting end 1351. The limiting end 1351 may be arranged obliquely relative to the connection body 132 and may extend toward the inlet/outlet 122. The first limiting portion 126 may have a second limiting recess 1260. The limiting end 1351 may be engaged in the second limiting recess 1260. When the connecting member 13 slides to the working position, the limiting end 1351 may be engaged in the second limiting recess 1260. Direct or indirect pressing of the second limiting portion 135 may enable the limiting end 1351 to be disengaged from the second limiting recess 1260.

Specifically, the second limiting recess 1260 may be formed on an inner side wall for forming the mounting cavity 12*a* (i.e., the inner wall of the top shell body 121), located between the inlet/outlet 122 and guiding hole 123. The second limiting recess 1260 may be an open recess with an opening facing the guiding hole 123. The second limiting recess 1260 and the guiding hole 123 may be communicated with each other via a smooth transition area formed by a smooth face free of protrusions, allow an unobstructed movement of the limiting end 1351 between the second limiting recess 1260 and the guiding hole 123. The second limiting portion 135 may form a included angle R with the connection body 132, oriented toward the inlet/outlet 122. The second limiting portion 135 may function like a spring plate bent from the connection body 132, the limiting end 1351 may be compressed by the top shell body 121 or pressed perpendicular to the sliding direction of the connecting member 132 to reduce the included angle β, which may recover when an external force applied to the limiting end 1351 is removed.

When the connecting member 13 is in the retracted position, the limiting end 1351 may abut against the inner wall for forming the mounting cavity 12*a* with the included angle R oriented toward the second limiting recess 1260. This arrangement allows the limiting end 1351 to be engaged in the second limiting recess 1260 when the connecting member 13 slides from the retracted position to the working position, thereby preventing a further sliding of the connecting member 13 toward the inlet/outlet 122 and maintaining the scraper in the working state. During this process, since the limiting end 1351 remains in constant contact with the inner wall for forming the mounting cavity 12*a* and the included angle β faces the second limiting recess 1260, users may switch the scraper from the retracted state to the working state simply by pushing the connecting member 13 without performing any additional operations. Similarly, pushing the connecting member 13 toward the access opening 101 may easily switch the scraper back to the retracted state, facilitating convenient operation and storage for the user.

When replacing the working blade 2 of the scraper, applying a direct pressure on the limiting end 1351 with the other hand or indirectly exerting a force through a second button 6 described below may cause the second limiting portion 135 to deform toward the bottom shell body 120, thereby enabling the limiting end 1351 to be disengaged from the second limiting recess 1260. This may allow a continued pushing of the connecting member 13 toward the inlet/outlet 122 direction until the working blade 2 fully extends out of the mounting cavity 12*a* for replacement. In this position, the limiting end 1351 may still contact the inner wall for forming the mounting cavity 12*a*, with the included angle β now facing away from the second limiting recess 1260. A smooth transition face between the limiting end 1351 and fixed end 1350 may ensure that when the connecting member 13 slides back to working position from this position, the limiting end 1351 won't be interfered by the second limiting recess 1260, enabling a smooth sliding from this position toward the retracted position. In this way, the user may be allowed to quickly switch the scraper between the working state and the retracted state after replacing the working blade 2 on the mounting portion 130, significantly improving operational convenience and user experience.

Figure 5:
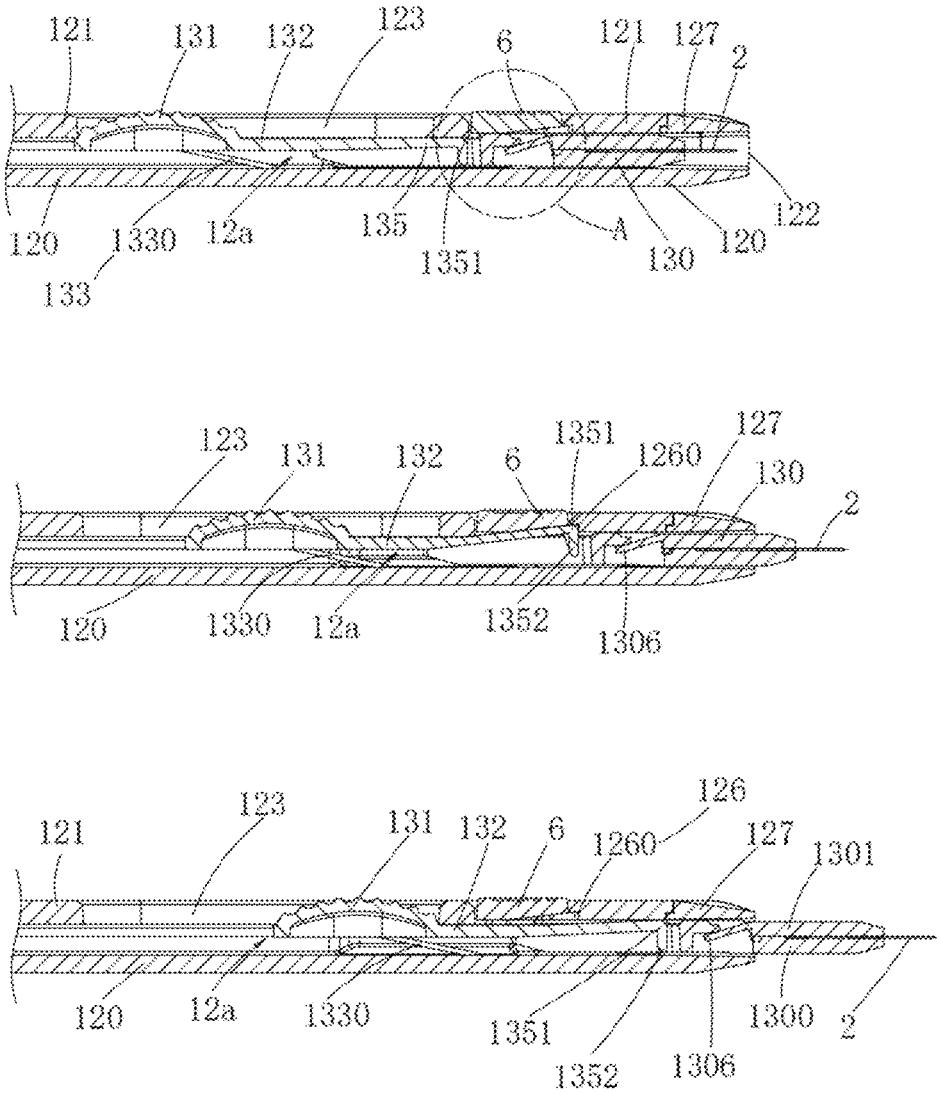
FIG. 5 is a first cross-sectional view of the overall structure of the scraper according to some embodiments of the present disclosure, showing a connecting member in a retracted position, a working position, and a replacement position.

Referring to FIGS. 3, 5 and 6, in some embodiments, the scraper may further include a second button 6. The shell 12 may define a mounting through hole 1213. The mounting cavity 12*a* may be communicated with an exterior of the scraper via the mounting through hole 1213. The second button 6 may be mounted in the mounting through hole 1213, which may be specifically formed in the top shell body 121. When the connecting member 13 slides to the working position, the second button 6 may positionally correspond to the limiting end 1351, and pressing the second button 6 may enable the limiting end 1351 to be disengaged from the second limiting recess 1260. Specifically, when the connecting member 13 is in the working position, a side of the second button 6 facing the mounting cavity 12*a* may contact with the limiting end 1351, so that when no external force is applied to the second button 6, an elastic force of the second limiting portion 135 may keep the limiting end 1351 always pushing the second button 6 upward, exposing a top face of the second button 6 out of the mounting through hole 1213 for convenient pressing by the user.

To enhance the compactness of the internal structure of the scraper, referring to FIG. 10, in some embodiments, the connection body 132 may include a base plate 1320 and a functional plate 1321. The base plate 1320 may be connected with the fixed plate 1300 and the functional plate 1321, with a flexible connecting portion 1322 formed at a connection position between the base plate 1320 and the functional plate 1321. The base plate 1320 may define an accommodation hole 1323. The accommodation hole 1323 may be a rectangular hole in the base plate 1320 and may provide an avoidance and accommodation space for the second limiting portion 135. Specifically, the fixed end 1350 may be connected to the flexible connecting portion 1322, and the limiting end 1351 may extend obliquely toward the inlet/outlet 122. When no external force is applied to the limiting end 1351, the limiting end 1351 may be raised and away from the accommodation hole 1323, and when the limiting end 1351 is directly or indirectly pressed by an external force, the limiting end 1351 may enter the accommodation hole 1323.

The functional plate 1321 may serve as a supporting structure for the first button 131, the limiting protrusion 134*a* and the elastic support portion 133. The elastic support portion 133 may be specifically the support leg 1330 inclined toward the inlet/outlet 122, with a length of the support leg 1330 being smaller than a length of the functional plate 1321. As shown in FIGS. 11 and 12, each of the first button 131 and the limiting end 1351 may be arranged at a respective one of two ends of the flexible connecting portion 1322. The functional plate 1321 and the second limiting portion 135 may undergo a slight swinging around the flexible connecting portion 1322, with a swinging direction of the functional plate 1321 being opposite to a swinging direction of the second limiting portion 135. In this way, when the user presses the first button 131, the functional plate 1321 may be pressed downward and may move close to the bottom shell body 120, while the limiting end 1351 may be raised away from the accommodation hole 1323 and pressed tightly against the top shell body 121. This structural arrangement may ensure that when the user presses the first button 131 and pushes the first button 131 to slide from the retracted position to the working position, the limiting end 1351 may necessarily be cooperated with the first limiting portion 126 formed on the top shell body 121, preventing the limiting end 1351 from sliding toward the inlet/outlet 122. That is, when the connecting member 13 is in the working position, the connecting member 13 may not continue sliding to the replacement position, thereby ensuring that when the user operates the scraper with one hand, the user may switch the scraper only between the retracted state and the working state. To replace the working blade 2, the user must use the other hand to apply an indirect or direct pressing force to the limiting end 1351 to enable the limiting end 1351 to be disengaged from the second limiting recess 1260 for unlocking, significantly improving safety and practicality of the scraper during use.

It should be further noted that when the scraper is in the working state and the working blade 2 is subjected to a large reaction force, an action of the second component force on the support leg 1330 may also cause the functional plate 1321 to swing toward the bottom shell body 120, the limiting end 1351 to be raised away from the accommodation hole 1323 and pressed tightly against the inner wall of the top shell body 121 for forming the second limiting recess 1260, converting the reaction force on the working blade 2 to a locking force on the limiting end 1351, thereby improving structural stability of the scraper in the working state.

Referring to FIGS. 6 and 10, in some embodiments, the second limiting portion 135 may further include an overload protection leg 1352 protruding from the limiting end 1351 along a thickness direction of the limiting end 1351. The overload protection leg 1352 may at least partially pass through the accommodation hole 1323. Specifically, when no external force is applied to the limiting end 1351, the overload protection leg 1352 may be partially placed in the accommodation hole 1323. When the limiting end 1351 is pressed by an external force, the overload protection leg 1352 may partially pass through the accommodation hole 1323 and abut against the bottom shell body 120, forming support for the limiting end 1351, preventing excessive swinging of the limiting end 1351 that may cause breakage at a connection between the fixed end 1350 and the connection body 132, thereby improving a service life of an internal structure of the scraper. A contact face between the overload protection leg 1352 and the bottom shell body 120 may be a curved face, thereby reducing friction between the overload protection leg 1352 and the bottom shell body 120, allowing the user to push the connecting member 13 toward the replacement position more effortlessly when pressing the first button 131 and the second button 6.

Referring to FIGS. 6 and 9, in some embodiments, the connecting member 13 may further include a supporting protrusion 138 arranged on the connection body 132, specifically on the base plate 1320 and located between the accommodation hole 1323 and the fixed plate 1300. When the connecting member 13 is in the retracted position, the supporting protrusion 138 may support the second button 6, keeping the second button 6 received in the mounting through hole 1213. When the connecting member 13 moves from the retracted position to the working position, the second button 6 may fully be received in the mounting through hole 1213 under the support of the supporting protrusion 138, preventing the limiting end 1351 from abutting against a side wall of the second button 6 and avoiding interference of the second button 6 with the movement of the limiting end 1351.

Referring to FIGS. 4 and 7, in some embodiments, the shell 2 may further include a limiting platform 128, and the limiting platform 128 may be arranged in the mounting cavity 12*a*. The limiting platform 128 may be arranged on the inner wall form forming the mounting cavity 12*a* along a length direction of the mounting cavity 12*a*. The limiting platform 128 may limit a sliding stroke of the connecting member 13. Specifically, the mounting portion 130 may have a width greater than a width of the connection body 132. The limiting platform 128 is arranged at a portion of the mounting cavity 12*a* close to the inlet/outlet 122 and may abut against the mounting portion 130 to limit the sliding stroke of the connecting member 13. When the connecting member 13 is pushed to slide and the working blade 2 is retracted in the mounting cavity 12*a* through the inlet/outlet 122, the abutment between the mounting portion 130 and the limiting platform 128 may prevent the connecting member 13 from continuing to slide toward the receiving cavity 10*a*, further improving connection stability of the connecting member 13 in the main body 1. In other embodiments, the limiting platform 128 may also be arrange at a portion of the mounting cavity 12*a* away from the inlet/outlet 122, correspondingly causing the limiting platform 128 to abut against the base plate 1320 or the functional plate 1321 to restrict the sliding stroke of the connecting member 13.

In the above scraper, the top shell body 121 and the bottom shell body 120 are connected with each other through the shaft reinforcement portion 12*b* to improve connection stability between the top shell body 121 and the bottom shell body 120. When the cover 4 rotates repeatedly about the hinge axis, the shaft reinforcement portion 12*b* may counteract a force exerted by the cover 4 on the top shell body 121 or the bottom shell body 120 in the thickness direction of the shell 12, so that the top shell body 121 and the bottom shell body 120 may be less likely to crack during repeated rotation of the cover 4, preventing the cover 4 from being detached from the main body 1 at the hinge and improving connection stability between the cover 4 and the main body 1.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

What is claimed is:

1. A scraper, comprising:

a main body, comprising a top shell body and a bottom shell body; wherein the top shell body and the bottom shell body are engaged with each other and cooperatively define a receiving cavity with an access opening, and the receiving cavity is configured to store spare blades; and a cover, comprising a hinge portion pivotably connected to the main body, and rotatable about a hinge axis to close or open the access opening;

wherein the main body further comprises a shaft reinforcement portion, the shaft reinforcement portion is positioned adjacent to the hinge portion, and the top shell body and the bottom shell body are connected with each other via the shaft reinforcement portion wherein the top shell body and the bottom shell body cooperatively define a mounting cavity with an inlet/outlet, and the mounting cavity extends along a length direction of the main body; the shell comprises a first inner wall formed by the top shell body and a second inner wall formed by the bottom shell body: wherein the first inner wall and the second inner wall cooperatively form the mounting cavity the main body further comprises a connecting member, the connecting member is slidably mounted in the mounting cavity, the connecting member comprises a mounting portion for mounting a working blade, and the working blade is configured to partially extend out of the mounting cavity or be received in the mounting cavity through the inlet/outlet;

wherein the connecting member further comprises a first button and a connection body the connection body is connected to the mounting portion and the first button;

the top shell body defines a guiding hole, the mounting cavity is communicated with an exterior of the top shell body through the guiding hole, the guiding hole extends along a length direction of the mounting cavity, and the first button is partially arranged in the guiding hole wherein the connecting member further comprises:

an elastic support portion, arranged on a side of the connection body away from the guiding hole and configured to support the connection body; and a limiting protrusion, arranged on a side of the connection body and protruding towards the top shell body;

the top shell body further defines a first limiting recess and a locking recess, each of the first limiting recess and the locking recess is formed in the first inner wall, and the first limiting recess and the locking recess are distributed spaced from each other along a sliding direction of the connecting member;

the elastic support portion is configured to drive the limiting protrusion to be engaged in the first limiting recess or the locking recess via an elastic force of the elastic support portion, and pressing the first button enables the limiting protrusion to be disengaged from the first limiting recess or the locking recess.

2. The scraper according to claim 1, wherein the main body further comprises a shaft rod, and the shaft rod is arranged on one of the top shell body and the bottom shell body;

the hinge portion is rotatably connected to the shaft rod.

3. The scraper according to claim 1, wherein at least one of the top shell body and the bottom shell body defines an operation notch at the access opening, and the spare blades partially extend out of the receiving cavity through the operation notch;

the cover comprises a protruding portion, the protruding portion defines a receiving groove, and when the access opening is closed by the cover, the protruding portion is embedded in the operation notch, and the spare blades are partially received in the receiving groove.

4. The scraper according to claim 1, wherein one of the top shell body, the bottom shell body, and the cover defines a hanging through hole.

5. The scraper according to claim 1, wherein a wall of the shell defines at least one viewing window directly above or below the receiving cavity for observing a remaining quantity of the spare blades in the receiving cavity.

6. The scraper according to claim 5, wherein the number of the at least one viewing window is more than one, and the more than one viewing window is spaced apart from each other along a length direction of the receiving cavity.

7. The scraper according to claim 1, further comprising at least one magnetic member, wherein the at least one magnetic member is mounted in the main body and is configured to attract the spare blades in the receiving cavity.

8. The scraper according to claim 7, wherein a thickness direction of the receiving cavity is the same as a thickness direction of the spare blades;

the at least one magnetic member is arranged on a wall face for forming the receiving cavity in a thickness direction of the receiving cavity.

9. The scraper according to claim 1, wherein the elastic support portion comprises a support leg, a connecting end, and a contact end, each of the connecting end and the contact end is arranged at a respective one of two ends of the support leg, and the support leg is obliquely arranged on the connection body; the connecting end is connected with the connection body, and the contact end is configured to abut against the second inner wall away from the guiding hole; the contact end is closer to the inlet/outlet than the connecting end; or, the contact end is farther from the inlet/outlet than the connecting end.

10. A scraper, comprising:

a main body, comprising a top shell body and a bottom shell body: wherein the top shell body and the bottom shell body are engaged with each other and cooperatively define a receiving cavity with an access opening, and the receiving cavity is configured to store spare blades; and a cover, comprising a hinge portion pivotably connected to the main body, and rotatable about a hinge axis to close or open the access opening;

wherein the main body further comprises a shaft reinforcement portion, the shaft reinforcement portion is positioned adjacent to the hinge portion, and the top shell body and the bottom shell body are connected with each other via the shaft reinforcement portion;

wherein the top shell body and the bottom shell body cooperatively define a mounting cavity with an inlet/outlet, and the mounting cavity extends along a length direction of the main body: the shell comprises a first inner wall formed by the top shell body and a second inner wall formed by the bottom shell body; wherein the first inner wall and the second inner wall cooperatively form the mounting cavity;

the main body further comprises a connecting member, the connecting member is slidably mounted in the mounting cavity, the connecting member comprises a mounting portion for mounting a working blade, and the working blade is configured to partially extend out of the mounting cavity or be received in the mounting cavity through the inlet/outlet;

wherein the main body further comprises a first limiting portion, the first limiting portion is form on the first inner wall, and the connecting member further comprises a second limiting portion matched with the first limiting portion;

when the connecting member slides from a retracted position to a working position, the second limiting portion is cooperated with the first limiting portion to prevent the connecting member from continuing to slide toward the inlet/outlet, the working blade partially extends out of the mounting cavity through the inlet/outlet, and the scraper is in a working state;

when a force perpendicular to a sliding direction of the connecting member is applied to at least one of the second limiting portion and the first limiting portion, the second limiting portion is disengaged from the first limiting portion to release the connecting member, and when the connecting member slides to a replacement position, the working blade is in a replaceable state;

wherein the connecting member further comprises a connection body, the mounting portion is formed at one end of the connection body, the second limiting portion comprises a fixed end and a limiting end, the fixed end is connected to the connection body, and the limiting end is obliquely arranged relative to the connection body and extends toward the inlet/outlet;

the first limiting portion defines a second limiting recess, and the limiting end is configured to be engaged in the second limiting recess;

when the connecting member slides to the working position, the limiting end is engaged in the second limiting recess, and directly or indirectly pressing the second limiting portion enables the limiting end to be disengaged from the second limiting recess.

11. The scraper according to claim 10, further comprising a second button, the top shell body defines a mounting through hole, the mounting cavity is communicated with an exterior of the top shell body via the mounting through hole, and the second button is arranged to the mounting through hole; when the connecting member slides to the working position, the second button positionally corresponds to the limiting end, and pressing the second button enables the limiting end to be disengaged from the second limiting recess.

12. The scraper according to claim 11, wherein the connecting member further comprises a supporting protrusion, the supporting protrusion is arranged on the connection body, and when the connecting member is in the retracted position, the supporting protrusion supports the second button and enables the second button to be received in the mounting through hole.

* * * * *